US006891555B2

(12) United States Patent
Minowa et al.

(10) Patent No.: US 6,891,555 B2
(45) Date of Patent: May 10, 2005

(54) CARD-MAKING METHOD AND SYSTEM AS WELL AS HEAT TREATMENT MECHANISM FOR CARDS AND IMAGE-FORMING APPARATUS INCORPORATING THE SAME

(75) Inventors: Yoshiki Minowa, Okaya (JP); Ayao Ogawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 10/082,361

(22) Filed: Feb. 22, 2002

(65) Prior Publication Data

US 2002/0135658 A1 Sep. 26, 2002

(30) Foreign Application Priority Data

Mar. 6, 2001 (JP) ..... 2001-062123
Mar. 8, 2001 (JP) ..... 2001-065666

(51) Int. Cl.[7] ..... B41J 2/325
(52) U.S. Cl. ..... 347/171; 347/212
(58) Field of Search ..... 347/171, 212, 347/102, 107, 2, 4, 3; 400/120.01, 120.18

(56) References Cited

U.S. PATENT DOCUMENTS 5,326,179 A * 7/1994 Fukai et al. ..... 400/521
5,410,642 A * 4/1995 Hakamatsuka et al. .... 358/1.14
5,959,278 A * 9/1999 Kobayashi et al. ..... 235/449
RE38,295 E * 11/2003 Kobayashi et al. ..... 235/449
6,640,717 B2 * 11/2003 Kosaka et al. ..... 101/487
6,646,666 B2 * 11/2003 Matsuoka ..... 347/213
2002/0050527 A1 * 5/2002 Nishikawa et al. ..... 235/492

FOREIGN PATENT DOCUMENTS

JP 10-058638 3/1998
JP 10-244788 9/1998

* cited by examiner

*Primary Examiner*—Huan Tran
(74) *Attorney, Agent, or Firm*—Hogan & Hartson, LLP

(57) ABSTRACT

In a card-making method and system, an authentication card is made from a raw card having a readable and writable information-storing portion formed therein, by forming the image on the front surface and/or back surface of the raw card and writing individual authentication information in the information-storing portion. Processing information of the raw card is written in the information-storing portion. The image is formed based on the processing information read from the information-storing portion. Individual authentication information of the authentication card is written in the information-storing portion after forming the image. In a heat treatment mechanism for cards, heat treatment is applied to a card having an information-storing portion arranged in part of a surface of a card body of a card, by using a light source as a heating source, to thereby fix an image to the card. A light-blocking plate is arranged such that the light-blocking plate is positioned between the card and the light source to block irradiated light to the information-storing portion. An image-forming apparatus incorporating the heat treatment mechanism is also provided.

26 Claims, 14 Drawing Sheets

FIG. 7

| DATA WRITTEN IN CARD | MAIN CONTENTS OF DATA |
|---|---|
| SERIAL NUMBER | MANAGEMENT NUMBER OF RAW CARD |
| STRUCTURE CODE | HIGH-GRADE CARD<br>INEXPENSIVE CARD<br>DOUBLE-SIDED PRINTING/TRANSFER<br>ONE-SIDED PRINTING/TRANSFER |
| MATERIAL CONSTRUCTION CODE | SUBSTRATE LAYER<br>INK AFFIXATION LAYER<br>FLUORINE FILM LAYER<br>INK IMAGE-RECEIVING SHEET |
| CARD STANDARD CODE | MAGNETIC CARD<br>IC CARD<br>HYBRID CARD<br>POSITION OF INFORMATION-STORING PORTION |
| PRODUCTION CODE | PRODUCTION CODE/DATE/PLACE OF RAW CARD |
| | MAKING CODE/DATA/PLACE OF AUTHENTICATION |

CARD-MAKING METHOD AND SYSTEM AS WELL AS HEAT TREATMENT MECHANISM FOR CARDS AND IMAGE-FORMING APPARATUS INCORPORATING THE SAME

BACKGROUND OF THE INVENTION

1. Field of the Invention

This invention relates to a card-making method and system for making an authentication card by printing a desired image on a raw card having an information-storing portion, such as a magnetic stripe or an IC chip, and writing individual authentication information in the information-storing portion, as well as a heat treatment mechanism for heating a card having an information-storing portion arranged in part of a surface of a card body thereof, by using a light source as a heating source, and an image-forming apparatus incorporating the heat treatment mechanism.

2. Prior Art

Conventionally, in the card-making method of the above-mentioned kind, a raw card having an information-storing portion formed therein is introduced, for instance, into an ink jet printer for printing on cards, and desired characters are printed thereon (generally on a portion except for the information-storing portion). Then, the printed card is brought into a laminating device to laminate laminate films on the front and back surfaces thereof by thermal pressing. Finally, the laminated card is introduced into a data-writing device where individual authentication information which is different from one card to another is written in the information-storing portion. Thus, the authentication card is made.

In the above-described conventional card-making method, however, it is troublesome and actually impossible to properly carry out the above printing and laminating operations on a raw card without fault, although conditions for executing the printing and lamination can be adjusted depending on the material of the raw card. Further, since the printing and laminating methods thereof are simple, an authentication card made by the conventional method is low in security against forgery or illegal copying of the card.

Further, the card having an information-storing portion includes a magnetic card and an IC card which are conventionally known and typified by a cash card and a credit card. The information-storing portion corresponds to a magnetic stripe in the form of a tape in the case of the magnetic card, and an IC chip in the case of the IC card, which are incorporated in part of the surface of the body of the card. In the information-storing portion, information of the owner of the card and the like is stored to cause the card to have an individual authentication function. Usually, the card has a surface of a card body thereof subjected to uniform lamination treatment to impart lasting rub or abrasion resistance to the information-storing portion thereof. Further, when an image of a background, for instance, is desired to be expressed on the card, the image is printed by printing technology on the card except the information-storing portion, and then the lamination treatment is effected on the surface of the card to protect the printed surface and the information-storing portion. The lamination treatment is carried out by providing a layer of a thermoplastic resin on the surface of the card body in advance, melting the thermoplastic resin by heat treatment, and then allowing the same to set by cooling, to form a resin film.

Now, in this case, the heat treatment is effected by using a pressure heat roller or the like to press the thermoplastic resin to a card while heating the same. However, if erroneous temperature control is carried out, part of a molten thermoplastic resin is attached to the pressure heat roller to cause damage of the resin film formed on the surface of the card or like problems. On the other hand, if the heat treatment is performed by using a non-contact heater which employs a light source as a heating source, there arise the following inconveniences:

If a magnetic card is subjected to the heat treatment by using a light source, heat is concentrated on a magnetic stripe which is dark-colored and hence high in absorbance. This sometimes causes the magnetic stripe to wrinkle to be partially peeled off the card body of the magnetic card, thereby degrading the performance and quality of the card. If an IC card is heated, irradiation of light from the light source can cause an erroneous operation of an IC chip depending on the wavelength range of the light. Further, if the card body of the IC card is shrunk and deformed due to the heating process, the IC chip can be broken. It is considered that such problems can occur not only when the heat treatment is carried out by using the light source so as to provide an appropriate laminate film on a card but also when a card printed with an image is heated in order to dry ink droplets, for fixation of the image.

SUMMARY OF THE INVENTION

It is a first object of the invention to provide a card-making method and system which is capable of stably making a high-quality and high-security authentication card from a raw card by utilizing an information-storing portion formed in the raw card before printing.

It is a second object of the invention to provide a heat treatment mechanism for fixing an image to a card and an image-forming apparatus incorporating the same, which are capable of properly preventing direct thermal influence of heat irradiation on an information-storing portion of a card in a heating process by a light source.

To attain the first object, according to a first aspect of the invention, there is provided a card-making method of making an authentication card from a raw card having a readable and writable information-storing portion formed therein, by forming an image on at least one of a front surface and a back surface of the raw card and writing individual authentication information in the information-storing portion.

The card-making method according to the first aspect of the invention is characterized by comprising the steps of:

- writing processing information of the raw card in the information-storing portion;
- forming the image based on the processing information read from the information-storing portion; and
- writing individual authentication information of the authentication card in the information-storing portion after forming the image.

According to this card-making method, the processing information of a raw card is stored in advance in an information-storing portion thereof, an image is formed on the raw card based on the processing information, and further individual authentication information of an authentication card, which is different from card to card, is written in the information-storing portion, whereby the authentication card is made from the raw card.

In this case, an image can be formed on an individual card stably without fault since the processing information of a raw card is stored in advance in an information-storing portion thereof, and the image forming process is carried out by reading out the processing information. Further, by comparing the authentication card and processing information thereof with each other, a forged or illegally copied authentication card can be rejected. Furthermore, it is also possible to reject a forged or illegally copied raw card itself depending on the presence or absence of the processing information of the raw card.

Preferably, the step of forming the image comprises the steps of:

overlaying an ink image-receiving sheet to a surface of the raw card, printing the image on the ink image-receiving sheet by using a sublimable dye ink after the overlaying step, and thermally transferring the sublimable dye ink from the ink image-receiving sheet onto the surface of the raw card by heating the ink image-receiving sheet after the printing step.

According to this preferred embodiment, when the image is printed on the ink image-receiving sheet overlaid to the surface of the raw card, the sublimable dye ink is held in the ink image-receiving sheet, and when the ink image-receiving sheet is heated, the sublimable dye ink permeates into the uppermost layer of the raw card as migration particles having sizes at a molecular level, and develops color to form a transferred image. In this case, since a special image forming method is employed in which an image for transfer is caused to permeate deep into the uppermost layer of the raw card for fixation, it is possible to reliably reject a forged and illegally copied authentication card which has been made, by making use of the processing information of the card.

It should be noted that the overlaying step can be carried out e.g. by simply overlaying the ink image-receiving sheet to the raw card, or by affixing the ink image-receiving sheet to the raw card. Further, the printing step is preferably carried out by the ink jet printing method. Furthermore, although the step of thermally transferring the sublimable dye ink may be carried out either by a contact method or a non-contact method, far infrared radiation is preferable as the heating source.

Preferably, the step of forming the image comprises the steps of:

printing the image on an ink image-receiving sheet by using a sublimable dye ink, overlaying the ink image-receiving sheet to a surface of the raw card after the printing step, and thermally transferring the sublimable dye ink from the ink image-receiving sheet onto the surface of the raw card by heating the ink image-receiving sheet after the overlaying step.

According to this preferred embodiment, when the image is printed on the image-receiving sheet, the sublimable dye ink is held in the ink image-receiving sheet, and when the ink image-receiving sheet is overlaid to the surface of the raw card and heated, the sublimable dye ink permeates into the uppermost layer of the raw card as migration particles having sizes at a molecular level, and develops color to form a transferred image. In this case, since a special image forming method is employed in which an image for transfer is caused to permeate deep into the uppermost layer of the raw card, it is possible to reject a forged and illegally copied authentication card. Further, in this case, since the special image forming method is employed in which the image for transfer is caused to permeate deep into the uppermost layer of the raw card for fixation, it is possible to reliably reject a forged or illegally copied authentication card, by making use of the processing information of the card.

Preferably, the processing information is printing process information, and the step of forming the image includes controlling printing operation in the printing step, based on the printing process information.

According to this preferred embodiment, it is possible to employ a printing mode which agrees with the properties of the ink image-receiving sheet and the raw card or a printing mode in which the information of the front surface and back surface of the raw card or that of the forward end and backward end of the card is taken into account, so as to obtain an image of high quality.

Preferably, the printing process information comprises at least one of printing resolution information for printing operation, front/back-surface printing information for identifying a to-be-printed surface of the raw card, and forward/backward printing information for identifying forward and backward ends of the raw card.

According to this preferred embodiment, the degree of printing resolution can be adjusted in view of the properties of the ink image-receiving sheet and the raw card, or the manufacturing costs of the authentication card. Further, even when a raw card introduced for printing has front and back surfaces or forward and backward ends, the image can be printed on the raw card by taking these factors into account. It should be noted that information for identifying the position of the information-storing portion of the raw card may be included in the front/back-surface printing information such that printing of the information-storing portion can be cancelled partially.

Preferably, the processing information is thermal treatment information, and the step of forming the image includes controlling heating operation performed in the step of thermally transferring the sublimable dye ink, based on the thermal treatment information.

According to this preferred embodiment, it is possible to employ a heating mode adapted to the materials of the ink image-receiving sheet and the raw card and the lamination structure of the raw card (e.g. by taking into account the softening temperatures of the sheet and the card, and the warp of the card), or alternatively a heating mode in which a thermal damage exerted on the information-storing portion is taken into account. Further, a heating mode can be employed in view of correlation between the depth of permeation of the sublimable dye ink into the raw card and the amount of heat applied to the raw card. Still further, when attention is paid to the above correlation, the depth of permeation of the sublimable dye ink can be utilized as an index indicative of whether or not an authentication card is forged or illegally copied.

Preferably, the thermal treatment information comprises at least one of heating information consisting of a heating temperature and a heating time period of the heating operation, and storage portion type information for protecting the information-storing portion from being heated.

According to this preferred embodiment, the heating information enables an image of high quality to be formed in a manner adapted to the materials of the ink image-receiving sheet and the raw card as well as an image to be formed in view of prevention of forgery and illegal copying of a card printed with the image. Further, the storage portion type information makes it possible to change a heating mode for heating the raw card as required, depending on whether or not the information-storing portion of the card is formed e.g. by a magnetic stripe or an IC chip, which results in minimization of a thermal damage exerted on the information-storing portion of each of various types of raw cards.

Preferably, the heating temperature and the heating time period are set by taking a temperature gradient into account.

According to this preferred embodiment, it is possible to employ a heating mode which takes into account heat conduction in the direction of the thickness of the ink image-receiving sheet and raw card. This makes it possible to prevent a surface of the raw card from being burnt without exerting adverse influence on the thermal transfer of the image.

Preferably, the storage portion type information comprises information of a position of the information-storing portion in the raw card.

According to this preferred embodiment, heating of each of raw cards can be performed such that the part of the information-storing portion is prevented from being heated, which makes it possible to minimize a thermal damage exerted on the information-storing portion.

Preferably, the step of writing individual authentication information includes rewriting the processing information to the individual authentication information.

According to this preferred embodiment, if the processing information of the authentication card is determined to be unnecessary, the processing information can be deleted automatically and with ease.

Preferably, the individual authentication information comprises card-making information including a date of making of the authentication card.

According to this preferred embodiment, it is possible to use the card-making information held in the authentication card for the quality control of each authentication card and prevention of forgery thereof. Further, a production place, a lot number, and the like can be included in the card-making information in addition to the date of making. Further, the above processing information can be preserved as part of the card-making information.

Preferably, the method further includes the step of storing the processing information as history information of the authentication card prior to the writing step.

According to this preferred embodiment, conditions for forming the image printed on the authentication card can be stored and preserved in the history information. The conditions can be used for quality control of the authentication card or an index of judgement for prevention of forgery thereof.

Preferably, the method further includes the step of writing source identification information of the raw card in the information-storing portion prior to the step of forming the image.

According to this preferred embodiment, by using the source identification information, it is possible to prevent forgery and illegal copying of the raw card itself. Further, the source identification information can be employed for the quality control of the raw card.

Preferably, the source identification information comprises production information including a date of production of the raw card.

According to this preferred embodiment, the production information can be used for the quality control of the raw card. Particularly, when the above ink image-receiving sheet is affixed to the raw card when the raw card is made, the production information can be utilized for the quality control of the ink image-receiving sheet, including detection of the degree of degradation thereof. Further, a production place, a lot number, and the like can be included in the production information in addition to the production date in the production information.

Preferably, the information-storing portion includes a processing information-storing portion for storing the processing information, and an authentication information-storing portion for storing the individual authentication information, which have been formed in the raw card, independently of each other.

According to this preferred embodiment, an authentication card storing and holding (the history) of the processing information can be made, and the history processing information can be used for the quality control of the authentication card and prevention of forgery thereof.

To attain the first object, according to a second aspect of the invention, there is provided a card-making method of making an authentication card from a raw card having a readable and writable information-storing portion formed therein, by forming an image on at least one of a front surface and a back surface of the raw card and writing individual authentication information in the information-storing portion.

The card-making method according to the second aspect of the invention is characterized by comprising the step of writing source identification information of the raw card in the information-storing portion.

According to this card-making method, it is possible to make use of the source identification information stored and held in the information-storing portion for prevention of forgery of the raw card and the authentication card and the quality control thereof. Although the source identification information may be deleted from the information-storing portion when the authentication card is made, in such a case, it is preferred that the source identification information is preserved as history information in some way or other.

Preferably, the source identification information comprises production information including a date of production of the raw card.

According to this preferred embodiment, the production information can be utilized for the quality control of the raw card. It should be noted that in addition to the date of making, a production place, a lot number, and the like can be included in the card-making information.

To attain the first object, according to a third aspect of the invention, there is provided a card-making system for making an authentication card from a raw card having a readable and writable information-storing portion formed therein, by forming an image on at least one of a front surface and a back surface of the raw card and writing individual authentication information in the information-storing portion.

The card-making system according to the third aspect of the invention is characterized by comprising:

processing information-writing means for writing processing information of the raw card in the information-storing portion;

processing information readout means for reading out the processing information from the information-storing portion;

image forming means for forming the image on the raw card;

image-forming control means for controlling the processing information readout means and the image forming means; and authentication information-writing means for writing individual authentication information of the authentication card in the information-storing portion, wherein the image-forming control means controls an image forming process carried out by the image forming means for forming the image, based on the processing information read from the information-storing portion.

According to this system, the processing information of the raw card is stored in the information-storing portion by the processing information storage means, and then the processing information is read out by the processing information readout means. Next, the image forming means is controlled based on the processing information for forming the image on the raw card. Further, individual authentication information of the authentication card is written in the information-storing portion by the authentication information-writing means, whereby the authentication card is made from the raw card.

As described above, the processing information of the raw card is stored in advance in the information-storing portion of the raw card, and the image forming processing is carried out by reading out the processing information. Hence, an image can be formed on each card stably without fault. Further, by comparing the authentication card and processing information thereof with each other, it is possible to reject a forged or illegally copied authentication card. Further, it is also possible to reject a forged or illegally copied raw card itself depending on the presence or absence of the processing information of the raw card.

Preferably, the image forming means includes:

a printer mechanism for printing the image on an ink image-receiving sheet overlaid to a surface of the raw card by using a sublimable dye ink, and a thermal transfer mechanism for thermally transferring the sublimable dye ink from the ink image-receiving sheet onto the surface of the raw card by heating the ink image-receiving sheet after printing.

According to this preferred embodiment, when the image is printed on the ink image-receiving sheet overlaid to the surface of the raw card by the printer mechanism, the sublimable dye ink is held in the ink image-receiving sheet. Then, when the ink image-receiving sheet is heated by the thermal transfer mechanism, the sublimable dye ink permeates into the uppermost layer of the raw card as migration particles having sizes at a molecular level, and develops color to form a transferred image. In this case, since a special image forming method is employed in which an image for transfer permeates deep into the uppermost layer of the raw card for fixation, it is possible to reliably reject a forged or illegally copied authentication card, by making use of the processing information of the card.

Preferably, the image forming means includes:

a printer mechanism for printing the image on an ink image-receiving sheet by using a sublimable dye ink, an overlaying mechanism for overlaying the ink image-receiving sheet to a surface of the raw card after printing, and a thermal transfer mechanism for thermally transferring the sublimable dye ink from the ink image-receiving sheet onto the surface of the raw card by heating the ink image-receiving sheet after completion of overlaying.

According to this preferred embodiment, when the image is printed by the printer mechanism, the sublimable dye ink is held in the ink image-receiving sheet. Then, when the ink image-receiving sheet is overlaid to the surface of the raw card by the overlaying mechanism, and heated by the thermal transfer mechanism, the sublimable dye ink permeates into the uppermost layer of the raw card as migration particles having sizes at a molecular level, and develops color to form a transferred image. In this case as well, since a special image forming method is employed in which the an image for transfer permeates deep into the uppermost layer of the raw card for fixation, it is possible to reliably reject a forged or illegally copied authentication card, by making use of the processing information of the card.

Preferably, the processing information is printing process information, and the image-forming control means controls printing operation carried out by the printer mechanism based on the printing process information.

According to this preferred embodiment, it is possible to employ a printing mode which agrees with the properties of the ink image-receiving sheet and the raw card or a printing mode in which the information of the front surface and back surface of the raw card or that of the forward end and backward end of the card is taken into account so as to obtain an image of high quality.

Preferably, the printing process information comprises front/back-surface printing information for identifying a to-be-printed surface of the raw card, the image forming means including a card-inverting mechanism for inverting the raw card upside down, and the image-forming control means controlling the card-inverting mechanism based on the front/back-surface printing information.

According to this preferred embodiment, the card-inverting mechanism is controlled based on the front/back-surface printing information, whereby even if the raw card is introduced to the image forming means regardless of the front and back surfaces of the raw card, images to be printed on the respective front and back surfaces of the raw card can be reliably printed without mistaking the front surface for the back surface or vice versa.

Preferably, the printing process information comprises forward/backward printing information for identifying forward and backward ends of the raw card, the image forming means including a card-rotating mechanism for reversing the raw card forward end backward, and the image-forming control means controlling the card-rotating mechanism based on the forward/backward printing information.

Preferably, the printing process information comprises forward/backward printing information for identifying forward and backward ends of the raw card, the image forming means including an image-rotating mechanism for reversing the image forward end side backward, and the image-forming control means controlling the image-rotating mechanism based on the forward/backward printing information.

According to these preferred embodiments, the card-rotating mechanism or the image-rotating mechanism is controlled based on the forward/backward printing information, whereby even if the raw card is introduced to the image forming means regardless of the forward and backward ends of the raw card, the image can be properly printed without mistaking the forward end for the backward end or vice versa.

Preferably, the processing information is thermal treatment information, and the image-forming control means controls heating operation performed by the thermal transfer mechanism based on the thermal treatment information.

According to this preferred embodiment, it is possible to employ a heating mode adapted to the materials of the ink image-receiving sheet and the raw card and the lamination structure of the raw card, or a heating mode which takes into account a thermal damage exerted on the information-storing portion, so as to obtain an excellent print image. Further, a heating mode can be employed in view of correlation between the depth of permeation of the sublimable dye ink into the raw card and the amount of heat applied to the raw card. Still further, when the above correlation is considered, the depth of permeation of the sublimable dye ink can be used as an index indicative of whether or not the authentication card is forged or illegally copied.

Preferably, the thermal treatment information includes storage portion type information for protecting the information-storing portion from being heated, the image forming means including a heating prevention mechanism facing the thermal transfer mechanism, for preventing the information-storing portion from being heated, and the image-forming control means controlling the heating prevention mechanism based on the storage portion type information.

According to this preferred embodiment, the heating prevention mechanism is controlled based on the storage portion type information, whereby it is possible to prevent the portion of the information-storing portion from being heated, thereby minimizing a thermal damage exerted on the information-storing portion without causing any trouble in carrying out thermal transfer of the image.

Preferably, the thermal treatment information comprises storage portion type information for protecting the information-storing portion from being heated, the thermal transfer mechanism having a plurality of divisional heating sections which are capable of partially heating the card depending on a type of the information-storing portion, and the image-forming control means turning off only power for one of the divisional heating sections corresponding to the information-storing portion based on the storage portion type information.

According to this preferred embodiment, only power for the divisional heating section corresponding to the information-storing portion is turned off based on the storage portion type information, whereby it is possible to prevent the portion of the information-storing portion from being heated, thereby minimizing a thermal damage exerted on the information-storing portion without causing any trouble in carrying out thermal transfer of the image.

Preferably, the card-making system further includes history information storage means for storing the processing information as history information of the authentication card.

According to this preferred embodiment, conditions for forming the image on the authentication card can be stored and preserved by the history information storage means. This makes it possible to properly carry out the quality control of the authentication card and prevent forgery thereof.

Preferably, the history information storage means is formed by a personal computer linked to the processing information-writing means.

According to this preferred embodiment, the history information can be properly stored in an internal storage device or an external storage medium of the personal computer such that it can be read out easily as required.

Preferably, the card-making system further includes identification information-writing means for writing source identification information of the raw card in the information-storing portion.

According to this preferred embodiment, since the source identification information of the raw card can be stored and preserved in the information-storing portion, it is possible to prevent forgery and illegal copying of the raw card itself. Further, the source identification information can be employed for the quality control of the raw card.

Preferably, the information-storing portion includes a processing information-storing portion for storing the processing information, and an authentication information-storing portion for storing the individual authentication information, which have been formed in the raw card independently of each other.

According to this preferred embodiment, it is possible to make an authentication card having the processing information stored and preserved therein. The processing information can be employed for carrying out the quality control of the authentication card and preventing forgery thereof.

Preferably, at least the processing information readout means, the image forming means, and the image-forming control means out of the processing information-writing means, the processing information readout means, the image forming means, the image-forming control means, and the authentication information-writing means are accommodated in a single casing to form a card-making apparatus.

According to this preferred embodiment, the processing information readout means, the image forming means, and the image-forming control means which make it troublesome to transport and handle the raw card are integrally formed as the card-making system. This makes it possible to promote automation of a card making process, and thereby makes it possible to produce authentication cards of high quality with ease and in a stable fashion.

To attain the second object, according to a fourth aspect of the invention, there is provided a heat treatment mechanism for applying heat treatment to a card having an information-storing portion arranged in part of a surface of a card body of a card, by using a light source as a heating source, to thereby fix an image to the card.

The heat treatment mechanism according to the fourth aspect of the invention is characterized in that the heat treatment mechanism comprises a light-blocking plate which is arranged such that the light-blocking plate is positioned between the card and the light source to block irradiated light to the information-storing portion.

According to this heat treatment mechanism, light emitted from the light source is irradiated on a surface of the card except for the part of the surface having the information-storing portion arranged therein, and this irradiation of light effects heat treatment on the card. This makes it possible to apply heat treatment to the entire card in a state in which thermal influence of heating against the information-storing portion is properly prevented by preventing direct irradiation of light to the information-storing portion and heat concentration thereto. It should be noted that the information-storing portion stores information of the owner of the card and the like to exhibit the performance of an individual authenticating function of the card. A magnetic stripe in a magnetic card and an IC chip in an IC card correspond to the information-storing portion.

Preferably, the heat treatment mechanism includes a light-diffusing plate interposed between the light source and the light-blocking plate, for diffusing the irradiated light from the light source.

According to this preferred embodiment, light emitted from the light source passes through the light-diffusing plate and is irradiated on the surface of the card as diffused light. This makes it possible to cause a point (or linear) light source to serve as a planar light source for heating the card, thereby subjecting the card to uniform heat treatment within a plane thereof.

To attain the second object, according to a fifth aspect of the invention, there is provided a heat treatment mechanism for applying heat treatment to a card having an information-storing portion arranged in part of a surface of a card body of a card, by using a light source as a heating source, to thereby fix an image to the card.

The heat treatment mechanism according to the fifth aspect of the invention is characterized by comprising a light-transmissive separation board arranged between the light source and the card, and in that the separation board has a mask portion provided in a manner associated with the information-storing portion, for blocking irradiated light to the information-storing portion.

According to this heat treatment mechanism, the heat treatment of the card by heat emitted from the light source is performed by irradiating light having passed through the separation board onto the card, and at the same time by blocking direct irradiation of the light to the information-storing portion by using the mask portion formed on part of the separation board. This makes it possible to apply heat treatment to the entire card in a state in which thermal influence of heating against the information-storing portion is properly prevented by preventing direct irradiation of light to the information-storing portion and heat concentration thereto in accordance with the irradiation. It is preferred that the separation board is formed of a material having high transmittance while the mask portion being formed of a material having high reflectance and absorption rate of light. It should be noted that similarly to the above-described aspects of the invention, the information-storing portion stores information of the owner of the card to perform the function of authentication of the individual user (owner).

Preferably, the mask portion is a thin film formed by carrying out surface treatment by a dry process.

According to this preferred embodiment, even if the separation board is made of glass, a mask portion difficult to be peeled off and durable can be formed with ease and high accuracy.

Preferably, the thin film is formed by depositing a metal material on the separation board by a physical vapor deposition method.

According to this preferred embodiment, the film is formed by a PVD (Physical Vapor Deposition) method, such as a vacuum deposition method, a sputtering method, or an ion plating method. Therefore, it is possible to deposit a film at a lower temperature and in a shorter time period as well as form a film denser and having a more uniform thickness than by a CVD (Chemical Vapor Deposition) method.

Preferably, the separation board is formed by a light-diffusing plate for diffusing the irradiated light from the light source.

According to this preferred embodiment, irradiated light which is emitted from the light source to pass through the separation board as the light-diffusing plate is diffused and irradiated onto the surface of the card as diffused light. This makes it possible to cause a point (or linear) light source to serve as a planar light source for heating the card, thereby subjecting the card to uniform heat treatment within a plane thereof.

Preferably, the light-diffusing plate also serves as an optical filter for allowing only light in an infrared radiation wavelength range, out of the irradiated light from the light source, to transmit therethrough and the light-diffusing plate is formed of heat-resistant glass in the form of a flat plate arranged in parallel with the card.

According to this preferred embodiment, light in wavelength ranges other than the infrared radiation, out of light emitted from the light source is absorbed or reflected by the light-diffusing plate. This makes it possible to irradiate infrared rays having long wavelengths and a relatively small amount of energy onto the card to uniformly heat the card in the direction of the thickness thereof, thereby enhancing heat efficiency in comparison with visible light and the like containing short-wavelength components. It should be noted that the heat-resistant glass is preferably formed by a material having high light transmittance, thermal diffusivity, and heat conductivity. In short, it is preferable to use Neoceram or the like as heat-resistant glass.

Preferably, the light source is formed by a halogen lamp which emits far-infrared rays as radiation in a main wavelength range.

According to this preferred embodiment, the halogen lamp as the heating source is quickly activated, which contributes to shortening of a time period required for carrying out the heating process. Further, it is possible to irradiate far-infrared rays having long wavelengths and a relatively small amount of energy onto the card to uniformly heat the card up to the inside thereof, thereby enhancing heat efficiency in comparison with visible light and the like having short wavelengths.

Preferably, the card body has a surface thereof laminated with an ink image-receiving sheet having an image printed thereon by using a sublimable dye ink, and the heat treatment effects thermal transfer of the image from a portion printed with the image by using the sublimable dye ink, to the surface of the card body.

According to this preferred embodiment, when the card is thermally treated, the sublimable dye ink held in the ink image-receiving sheet develops color on a surface of the card body to transfer an image onto the surface. This makes it possible to form an image on the card while preventing direct irradiation of light to the information-storing portion. It is preferred that a portion corresponding to the information-storing portion of the ink image-receiving sheet is not printed with an image.

Preferably, the ink image-receiving sheet is laminated on a surface of the card body, except for the information-storing portion.

According to this preferred embodiment, the ink image-receiving sheet is partially laminated on the surface of the card body except for the information-storing portion. It is preferred that the ink image-receiving sheet is formed of a material which is easy to peel off by heating such that the sheet is easily peeled off after the heat treatment.

To attain the second object, according to a sixth aspect of the invention, there is provided an image-forming apparatus for forming an image on a card having an information-storing portion arranged in part of a surface of a card body of the card, the image-forming apparatus comprising:

a printer mechanism for printing the image on an ink image-receiving sheet by using an sublimable dye ink; and a heat treatment mechanism for applying heat treatment to the card body and the ink image-receiving sheet printed with the image which are overlaid to each other, by using a light source as a heating source, to thereby fix the image printed on the image-receiving sheet to the card, the heat treatment mechanism including a light-blocking plate which is arranged such that the light-blocking plate is positioned between the card and the light source to block irradiated light to the information-storing portion.

According to this image-forming apparatus, printing of an image on the ink image-receiving sheet of the card, and heat treatment on the printed card can be carried out in succession by a single apparatus. Further, if printing operation is performed by the ink jet method, it is possible to form a transfer image of high image quality on the card. It should be noted that the ink image-receiving sheet may be coated on the surface of the card body such that it is overlaid to the card in advance, or alternatively it may be configured to be a so-called transfer sheet which is formed separately from the card body.

The above and other objects, features, and advantages of the invention will become more apparent from the following detailed description taken in conjunction with the accompanying drawings.

BRIEF DESCRIPTION OF THE DRAWINGS

FIGS. 3A to 3C are cross-sectional views schematically showing a procedure of forming an image on a card, in which:

FIG. 3A is a cross-sectional view schematically showing a card in a state printed with an image for permeation of ink droplets into the card;

FIG. 3B is a cross-sectional view schematically showing the card in a state subjected to heat treatment for permeation of ink droplets into a lower layer;

FIG. 3C is a cross-sectional view schematically showing the card in a state having an uppermost layer thereof peeled off after the heat treatment;

FIG. 7 is a table showing five examples of information stored in an information-storing portion of a card;

FIGS. 9A to 9D are cross-sectional views schematically showing a procedure of forming an image on a card in the second embodiment, in which:

FIG. 9A is a cross-sectional view schematically showing an ink image-receiving sheet in a state printed with an image;

FIG. 9B is a cross-sectional view schematically showing the ink image-receiving sheet in a state overlaid onto a card;

FIG. 9C is a cross-sectional view schematically showing the ink image-receiving sheet in a state affixed to the card by being pressed thereto while applying heat thereto;

FIG. 9D is a cross-sectional view schematically showing the ink image-receiving sheet in a state being peeled off from the card;

DETAILED DESCRIPTION OF PREFERRED EMBODIMENTS

The invention will now be described in detail with reference to the drawings showing preferred embodiments of the present invention (card-making method and system as well as heat treatment mechanism for cards and card-making system incorporating the same). The card-making system makes a card having an information-storing portion, typically, a cash card or a credit card. The card-making method forms an image on a raw card having the information-storing portion based on processing information stored in the information-storing portion, and then writes individual authentication information in the information-storing portion so as to create an authentication card. More specifically, the card-making system prints an image of a graphic, a photograph, a background, or the like, on the card, by the ink jet printing method using a sublimable dye ink while feeding the card, based on information read from the information-storing portion which exhibits an individual authenticating function of the authentication card upon completion of the manufacturing process, and then subjects the printed card to heat treatment by a light source to cause sublimation/diffusion of the ink to thereby transfer the image to the card, so as to form the image on the same.

Figure 1A:
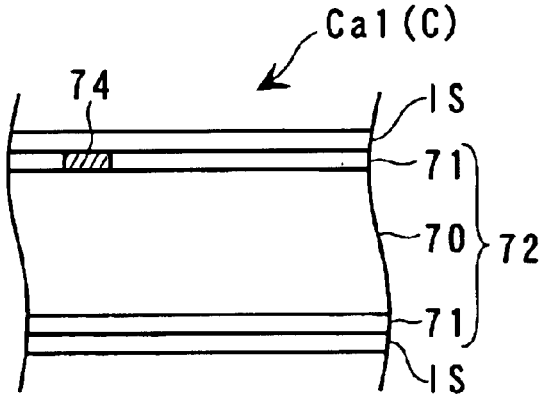
FIG. 1A is a cross-sectional view schematically showing the lamination structure of an inexpensive stripe magnetic card.
Figure 1B:
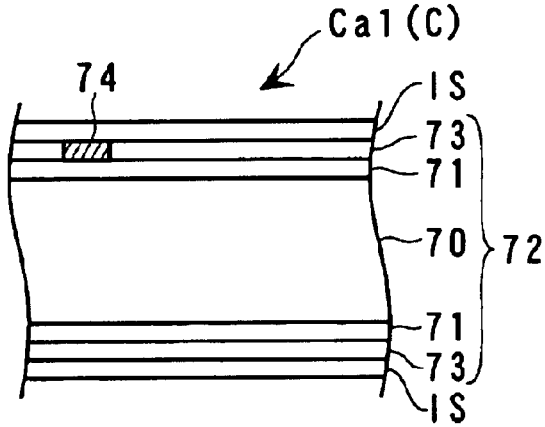
FIG. 1B is a cross-sectional view schematically showing the lamination structure of a high-grade stripe magnetic card.
Figure 1C:
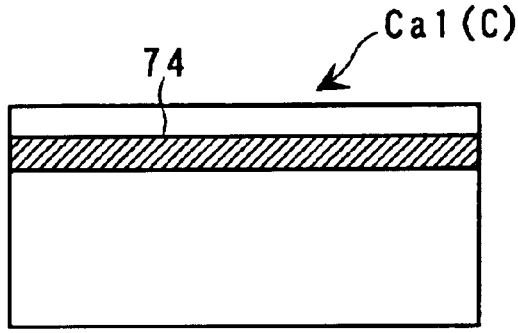
FIG. 1C is a plan view schematically showing the stripe magnetic cards shown in FIGS. 1A and 1B.
Figure 2A:
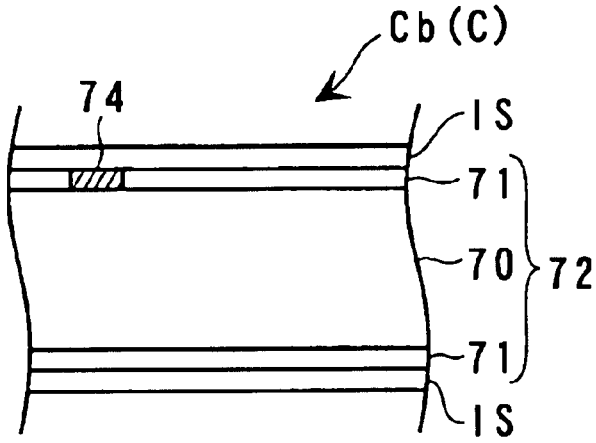
FIG. 2A is a cross-sectional view schematically showing the lamination structure of an inexpensive IC card.
Figure 2B:
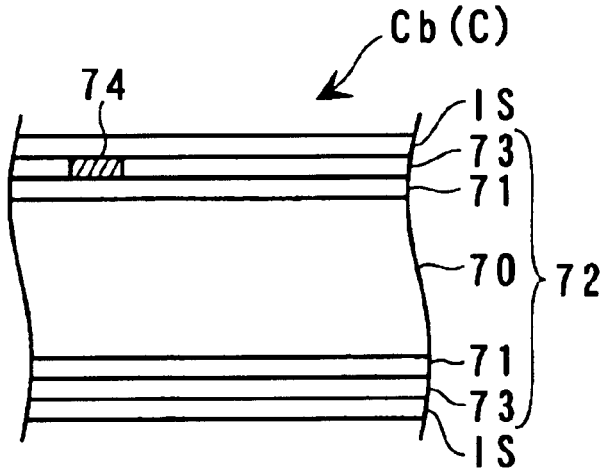
FIG. 2B is a cross-sectional view schematically showing the lamination structure of a high-grade IC card.
Figure 2C:
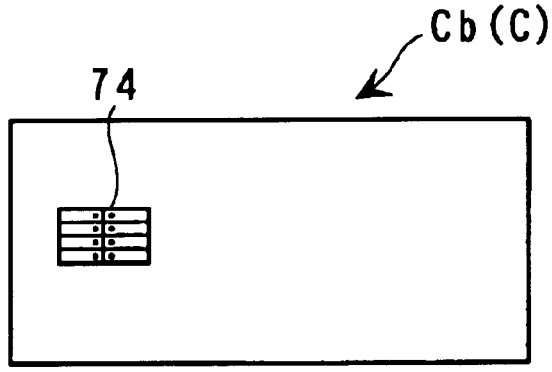
FIG. 2C is a plan view schematically showing the IC cards shown in FIGS. 2A and 2B.
Figure 3A:
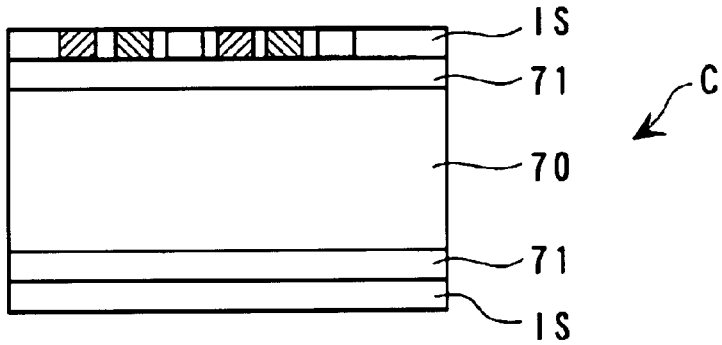
Figure 3B:
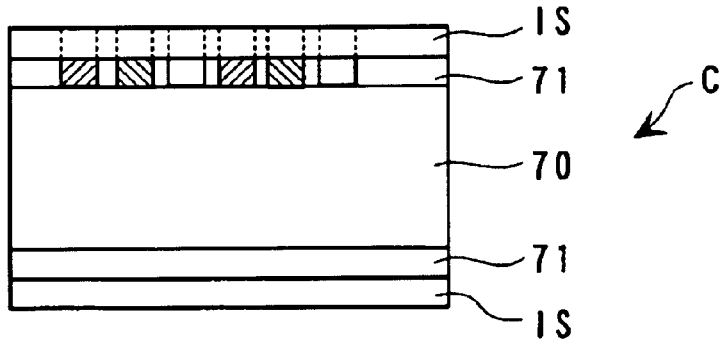
Figure 3C:
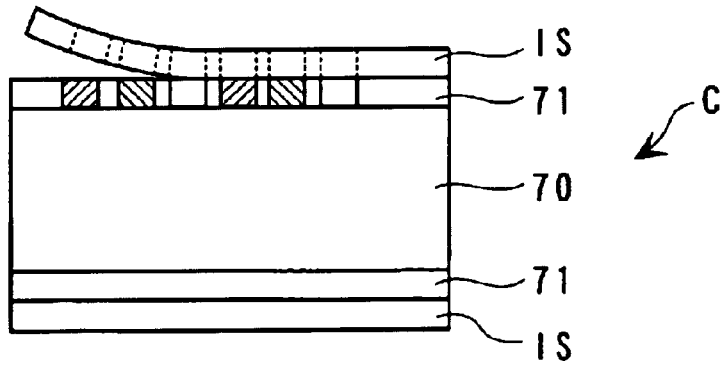
Figure 11A:
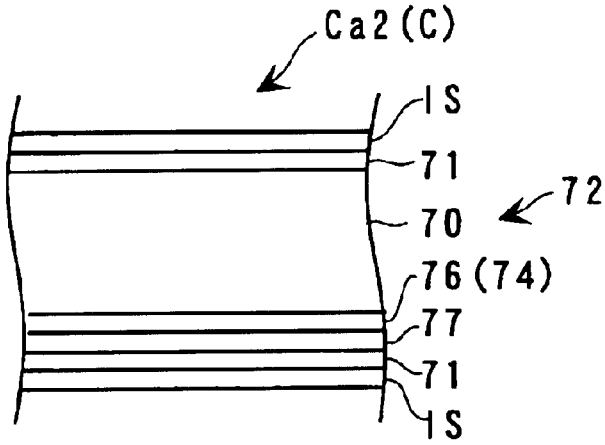
FIG. 11A is a cross-sectional view schematically showing the lamination structure of an inexpensive whole-surface magnetic card.
Figure 11B:
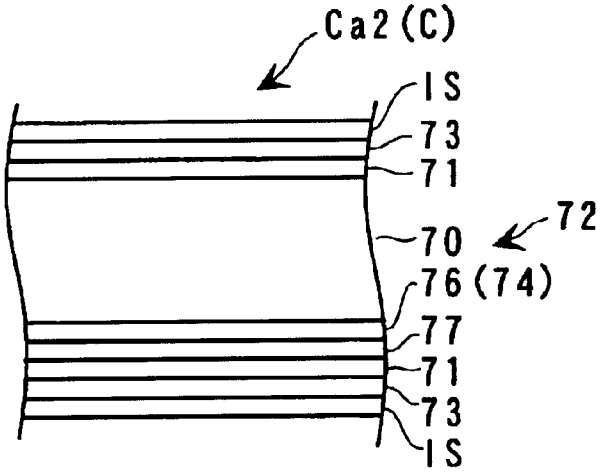
FIG. 11B is a cross-sectional view schematically showing the lamination structure of a high-grade whole-surface magnetic card.
Figure 11C:
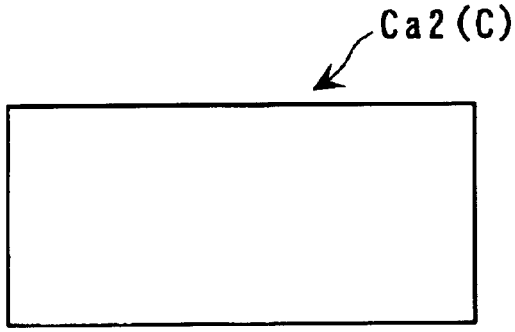
FIG. 11C is a plan view schematically showing the whole-surface magnetic cards shown in FIGS. 11A and 11B.

FIGS. 1A and 1B shows cross-sectional views schematically showing the lamination structures of stripe magnetic cards and FIG. 1C shows a plan view schematically showing the stripe magnetic cards shown in FIGS. 1A and 1B. FIGS. 11A and 11B shows cross-sectional views schematically showing the lamination structures of whole-surface magnetic cards and FIG. 11C shows a plan view schematically showing the whole-surface magnetic cards shown in FIGS. 11A and 11B. FIGS. 2A and 2B are cross-sectional views schematically showing the lamination structures of IC cards, and FIG. 2C is a plan view schematically showing the IC cards shown in FIGS. 2A and 2B. FIGS. 3A to 3C are cross-sectional views schematically showing a procedure of forming an image on these cards.

As shown in these figures, there are provided two types of cards, that is, inexpensive cards shown in FIGS. 1A, 2A and 11A, and high-grade cards shown in FIGS. 1B, 2B and 1B. In general, magnetic cards Ca include two types, i.e. stripe magnetic cards Ca1 shown in FIGS. 1A to 1C, and whole-surface magnetic cards Ca2 shown in FIGS. 11A to 11C. Further, in general, IC cards Cb include contact-type cards and non-contact type cards. In the present embodiment, however, both types of these IC cards are referred to by the term "IC cards". Hereinafter, let it be assumed that when a "card C" is simply referred to, it is intended to generically refer to both a magnetic card Ca and an IC card Cb.

The both types of cards C shown in FIGS. 1A, 2A, and 11A, and FIGS. 1B, 2B and 11B are each comprised of a card body 72 which is processed from its raw card status into a printed (image-formed) authentication card C as a final form thereof for use, and an ink image-receiving sheet IS laminated on each of a front surface and a back surface of the card body 72. The card body 72 is comprised of a substrate layer 70, and ink-fixing layers 71 laminated on respective opposite surfaces of the substrate layer 70, and has a laminate structure symmetrical with respect to the substrate layer 70. Further, the card body 72 includes an information-storing portion 74 in part of the front surface thereof (see FIGS. 1A, 2A, 11A). In short, the card C is configured such that it has the information-storing portion 74, and double-sided printing can be effected thereon.

The information-storing portion 74 is configured such that data can be read out therefrom and written therein. In the case of the stripe magnetic card Ca1, a magnetic stripe corresponds to the information-storing portion 74, which is a magnetically recordable belt-like layer laminated on part of the surface of the card body 72 thereof. The card body 72 of the raw card C is made into an authentication card formed with an image for being used finally. In the case of the whole-surface magnetic card Ca2, part of a magnetically recordable magnetic layer 76 uniformly laminated on a back surface of a card body 72 thereof corresponds to the information-storing portion 74. Further, in the case of the IC card Cb, a rectangular IC chip embedded in part of the surface of a card body thereof corresponds to the information-storing portion 74.

More specifically, in the case of the stripe magnetic card Ca1, the information-storing portion 74 is formed in an upper part of the front surface (back surface of the JIS 1 type) of the card body 72 (see FIG. 1C). In the case of the whole-surface magnetic card Ca2, on the back surface of the card body 72, the magnetic layer 76 formed of a magnetic material, and a magnetic covering layer 77 for protecting the magnetic layer 76 are uniformly laminated between the substrate layer 70 and an ink-fixing layer 71 sequentially from the side of the substrate layer 70, in a manner disposed over the entire surface of the back surface. The magnetic layer 76 has a desired part of the whole magnetic area thereof used as the information-storing portion 74 (detailed description will be given hereinafter). Further, in the IC card Cb, the card body 72 has an IC chip incorporated in a central left portion of the front surface of the card body 72 as viewed in FIG. 2C. It is preferred that the information-storing portion 74 is laminated on the front surface of the card body 72 such that the surface thereof is flush with another surface of the card body 72.

In the information-storing portion 74, processing information of a raw card C is stored by a card writer or the like at an early stage (raw card C) so as to allow the information to be utilized in a process for forming an image on the card C (printing and heat treatment). On the other hand, after the card C is handed to a user as the owner (as an authentication card C), the information-storing portion 74 can have individual or personal authentication information concerning the user himself stored therein, thereby performing a function of the personal authentication of the user. More specifically, the information-storing portion 74 plays a main role of the authentication card C after the manufacturing process, and at the same time it can be made use of by a card-making system 1, referred to hereinafter, as a readable medium from which processing information is read out in an image forming process of the manufacturing process. The information-storing portion 74 contributes to control of printing of the image and control of heat treatment for transfer of the image as well as management of the card C including prevention of forgery of the card (which will be described in detail hereinafter).

The cards C shown in FIGS. 1B, 2B and 11B each have fluorine film layers 73 laminated on the respective surfaces of the ink-fixing layer 71 in place of laminate films. In the case of the cards C shown in FIGS. 1A, 2A and 11A, ink image-receiving sheets IS are affixed via adhesive coated thereon to the surface of the ink-fixing layer 71, while in the case of the cards C shown in FIGS. 1B, 2B and 11B, ink image-receiving sheets IS are affixed via the adhesive coated thereon to the surface of the fluorine film layer 73.

The substrate layer 70 is formed of a plastic film formed e.g. of PVC (polyvinyl chloride) or PET (polyethylene terephthalate), or a synthetic paper so as to maintain the rigidity of the entire card C. Further, in general, the substrate layer 70 is formed of a basically white-colored material. The ink-fixing layer 71 is formed e.g. of a transparent PET film and functions as a layer which is impregnated with a sublimable dye ink to be fixed at the final stage of the printing process. While the ink image-receiving sheet IS is capable of temporarily holding the sublimable dye ink directly ejected thereon for printing, it is formed of a hydrophilic resin material which is easy to peel off by heating. In short, the adhesive of the ink image-receiving sheet IS is reduced in adhesive power after heating to make the sheet IS easy to be peeled off.

Referring to FIGS. 3A to 3C, when an image is printed on a card C by the ink jet printing method with the ink image-receiving sheet IS affixed to the card body 72 thereof, ink droplets of the sublimable dye ink are impregnated into the ink image-receiving sheet IS and held in the same (FIG. 3A). The ink droplets penetrate to the proximity of the boundary between the ink image-receiving sheet IS and the ink-fixing layer 71 arranged thereunder. When the card C is heated in this state, the ink droplets further penetrate deep into the ink-fixing layer 71 as migration particles having sizes at a molecular level (FIG. 3B). In other words, the ink droplets held in the ink image-receiving sheet IS are heated to be evaporated and diffused to develop color in the ink-fixing layer 71, whereby the image is fixed and formed in the ink-fixing layer 71. Thereafter, the ink image-receiving sheet IS is separated to expose the ink-fixing layer 71 (FIG. 3C), whereby the card C having the image thermally transferred into the ink-fixing layer 71 is made.

Similarly, when the cards C shown in FIGS. 1B, 2B and 11B, having the fluorine film layers 73 laminated thereon are used for printing, ink droplets are impregnated into the ink image-receiving sheet IS and held in the same. When the card C is heated in this state, the ink droplets pass through a fluorine film layer 73, followed by being diffused and fixed in the ink-fixing layer 71. Then, when the ink image-receiving sheet IS is separated, the card C is completed which has the fluorine film layer 73 as an outermost surface layer thereof for protecting a transferred image by the ink-fixing layer 71. Thus, the card C having the image formed thereon is made more excellent in weather resistance, light resistance, heat resistance, rub or abrasion resistance and chemical resistance due to characteristics of the fluorine film layers 73. Further, the fluorine film layers 73 give a high gloss to the card C.

Although in the present embodiment, the ink image-receiving sheets IS coated with adhesives are used for the cards C, this is not limitative, but a card C having the ink image-receiving sheet IS coated on each ink-fixing layer 71 in advance in the form of a layer may be used. Further, it is preferred that the ink image-receiving sheet IS is slightly larger than the card C in view of ease of peeling it off. This makes it possible to provide a peel-off margin on the ink image-receiving sheet IS and at the same time to carry out proper printing even up to all four edges of the card C (whole surface printing).

Further, each card C may be configured such that no images are printed on a portion of the ink image-receiving sheet IS corresponding to the information-storing portion 74. Alternatively, the ink image-receiving sheet IS may be laminated on the surface of the card body 72 except for the information-storing portion 74. Furthermore, it is also possible to omit the ink-fixing layers 71, which are transparent in view of reducing the manufacturing costs of the card C since ink can also be fixed to the substrate layer 70.

Figure 4:
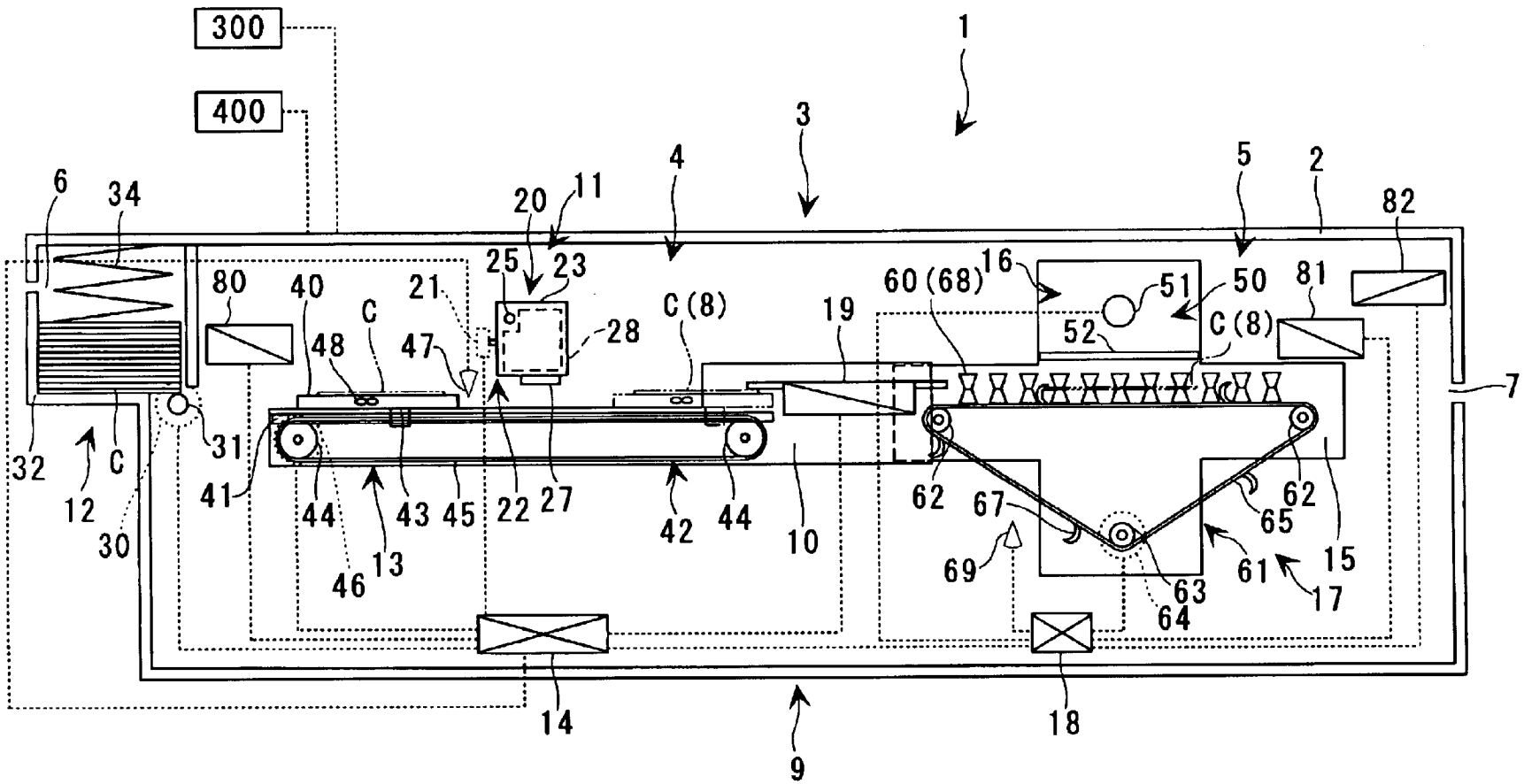
FIG. 4 is a cross-sectional view showing the internal construction of a card-making system according to a first aspect of the present invention.

Next, the card-making system 1 that makes cards by forming an image on each of the above cards C will be described with reference to FIG. 4 showing the internal construction of the card-making system. As shown in the figure, the card-making system 1 has an apparatus body 3 including an outer shell formed by a box-shaped casing 2, a printer block 4 arranged at a location leftward of the central portion of the apparatus body 3, for printing on the card C, and a heater block 5 arranged at a location rightward of the same for applying heat treatment to the printed card C. Further, the apparatus body 3 includes a controller 9 for controlling the printer block 4 and the heater block 5. In a printer block-side upper corner portion of the casing 2, there is formed a card supply port 6 via which each card C is introduced into the apparatus body 3, while in an intermediate portion of a heater block-side end wall of the casing 2, there is formed a card exit 7 via which the card C is delivered out of the apparatus. Further, in the apparatus body 3, a transport passage 8 for conveying the card C extends horizontally and linearly in a manner communicating between the card supply port 6 and the card exit 7.

It should be noted that a processing information-writing device (card writer, for instance) 300 for writing processing information in the information-storing portion 74 of the raw card C and an identification information-writing device 400 for writing source identification information in the same are provided separately from the card-making system 1, and these devices are linked to the card-making system 1 to form the whole card-making system. However, the identification information-writing device 400 may be incorporated in the processing information-writing device 300, or these devices 300, 400 may be both incorporated in the card-making system 1.

The printer block 4 is supported by left and right printer-block frames 10. The printer block 4 is comprised of a printer device 11 which carries out printing on the card C by a reciprocating head unit 20, a card feeder 12 which feeds cards C introduced into the card supply port 6, one by one, to the printer device 11, a processing information readout device 80 arranged between the printer device 11 and the card feeder 12, a printer-block conveyor device 13 which sucks the card C fed from the card feeder 12 thereon and carries the card C along the transport passage 8 to the printer device 11, and a printer-side controller 14 which performs centralized control of the operations of the devices 11, 12, 80, 13.

Each of the cards C sent one by one from the card feeder 12 is received by the printer-block conveyor device 13 after processing information thereof is read out from the information-storing portion 74 by the processing information readout device 80. Then, each card C is printed while passing by the head unit 20, followed by being sent to the heater block 5. When passing under the head unit 20, the card C is fed or advanced intermittently. On the other hand, the head unit 20 carries out printing on the card C while reciprocating in a direction orthogonal to the card-feeding direction. More specifically, printing operation is performed by the ink jet method using the sublimable dye ink such that the feed of the card C and the reciprocating motion of the head unit 20 serve as the main scanning and the sub scanning in printing technology, respectively.

The heater block 5 is supported by left and right heater-block frames 15. The heater block 5 is comprised of a heater device 16 (thermal transfer mechanism) which subjects the printed card C received from the printer block 4 to heat treatment, a heater-block conveyor device 17 which carries the card C received from the printer-block conveyor device 13 along the transport passage 8 to pass the card C through the heater device 16 and then deliver the same out of the casing 2 via the card exit 7, an authentication information-writing device 81 for writing individual authentication information in the card C at a location forward or downstream of the heater-block conveyor device 17, a laminate affixation device 82 for affixing a laminate tape to the card C as required at a location forward or downstream of the authentication information-writing device 81, and a heater-side controller 18 which performs centralized control of the operations of the devices 16, 17, 81, 82. Each card C fed from the printer block 4 has the print image finally transferred thereto and the individual authentication information written into the information storage portion 74 thereof, followed by being delivered out via the card exit 7.

Between the printer block 4 and the heater block 5, there is arranged a card transfer device 19 on the transport passage 8, for properly transferring the card C from the printer-block conveyor device 13 to the heater-block conveyor device 17. The card transfer device 19, which is supported by the printer-block frames 10 or the heater-block frames 15, temporarily receives the card C from the printer-block conveyor device 13 and then transfers the same to the heater-block conveyor device 17.

The printer-side controller 14 and the heater-side controller 18 are integrally formed on a single circuit board as a unitary controller 9 including a CPU 210 for carrying out various control operations and the like (see FIG. 6: detailed description will be given hereinafter). The controller 9 controls the printer block 4 and the heater block 5 such that they are operated separately and in a manner correlated with each other, to carry out the image forming process for printing an image on the card C (raw card C) fed to the printer block 4, and then apply heat treatment to the printed card C, based on the processing information of the card C, and cause individual authentication information to be written in the card C, followed by causing the card C to be delivered as the authentication card out of the casing 2 via the card exit 7.

Now, each component device of the printer block 4 will be described. The printer device 11 is comprised of the head unit 20, a carriage motor 21 as a drive source, and a reciprocating mechanism 22 which receives torque from the carriage motor 21 to reciprocate the head unit 20. The carriage motor 21 is connected to the printer-side controller 14. The head unit 20 is comprised of an ink jet head 27 having a plurality of nozzles formed in an underside surface thereof, an ink cartridge 28 which supplies ink to the ink jet head 27, and a carriage 23 carrying the ink jet head 27 and the ink cartridge 28. The ink cartridge 28 contains sublimable dye inks of four colors, i.e. yellow (Y), cyan (C), magenta (M), and black (K). It should be noted that the ink cartridge 28 may contain inks of six colors including two other colors, i.e. light cyan (LC) and light magenta (LM), in addition to the above four.

The sublimable dye inks are each formed of a sublimable dye and exhibits sublimation properties when exposed to heat. As described above, each sublimable dye ink is impregnated into the ink image-receiving sheet IS and temporarily held in the same. Then, the sublimable dye ink is transferred into the ink-fixing layer 71 under the ink image-receiving sheet IS by being heated in the heating process, and diffused and evaporated in the ink-fixing layer 71, for color development.

The reciprocating mechanism 22 includes a carriage guide shaft 25 having opposite ends thereof supported by left and right guide frames, and a timing belt, not shown, extending in parallel with the carriage guide shaft 25. The carriage 23 is supported by the carriage guide shaft 25 such that the carriage 23 can perform reciprocating motion. Further, the carriage 23 has a portion thereof fixed to the timing belt. When the carriage motor 21 drives the timing belt via a pulley to cause the same to travel in the normal and reverse directions, the carriage 23 performs reciprocating motion while being guided by the carriage guide shaft 25. During this reciprocating motion of the carriage 23, ink is ejected from the ink jet head 27 as required, whereby printing is effected on the card C. It should be noted that the ink jet head 27 is controlled not to eject the sublimable dye ink to an area corresponding to the information-storing portion 74 when a surface including the information-storing portion 74 is printed.

The card feeder 12 is comprised of a feed motor 30 as the drive source, a feed roller 31 rotated by the feed motor 30, a card cassette 32 containing a plurality of cards C in a stacked manner. The card cassette 32 is formed by projecting a rear side portion of the casing 2 outward, and has an inner plane shape generally similar to the plane shape of the card C. Further, the card cassette 32 has a predetermined depth which allows a plurality of cards C to be set in a stacked manner. The card supply port 6 is formed in an upper portion of the card cassette 32, and when cards C are stacked up to the card supply port 6, the upper surface of the topmost card C is pressed downward by a spring 34 when the card cassette 32 is closed.

The feed roller 31 is arranged under a front portion of the card cassette 32 in a manner held in rolling contact with a forward portion of the underside surface of a lowermost one of the stacked cards C. The feed motor 30 is connected to the printer-side controller 14, for controlling rotation of the feed roller 31. A front wall of the card cassette 32 extends downward to a location below which the lowermost card C alone is allowed to pass. The front wall blocks forward motion of a card C immediately upon the lowermost card C during feeding of the lowermost card C by the feed roller 31, which ensures that the cards C are reliably fed one by one from the feed roller 31 to the processing information readout device 80.

The processing information readout device 80 is formed by a card reader, not shown, which faces the transport passage 8 (information-storing portion 74 of the card C) for reading out the processing information of the card C. The card reader connected to the printer-side controller 14 is comprised of a magnetic data-reading device corresponding to the information-storing portion 74 of the magnetic card Ca, and an IC data-reading device corresponding to the information-storing portion 74 of the IC card Cb. The magnetic data-reading device is formed by a magnetic head for scanning a magnetic stripe and the like while the IC data-reading device is formed by IC connection terminals for connection to input/output contacts of an IC chip for inputting and outputting information. The card C passing under the processing information readout device 80 has its processing information including information of a type thereof (the magnetic card Ca or the IC card Cb) read out by either of the data-reading devices, and the image forming process is carried out for printing on the card C and heating the same based on the information.

It should be noted that a card transport adjustment device, not shown, for adjusting the transport of the card C is arranged at a location forward of the information readout device 80 on the forward end side facing the printer-block conveyor device 13. The card transport adjustment device includes a card-inverting mechanism for inverting the card C upside down, and a card-rotating mechanism for inverting the card C forward end side backward, each of which is connected to the printer-side controller 14. The card-inverting mechanism and the card-rotating mechanism are controlled based on processing information of the card C read out by the information readout device 80.

The card-inverting mechanism is formed by a catcher capable of receiving and passing the card C. The catcher includes a pair of rotating operation plates arranged in a manner opposed to each other via the transport passage 8. The pair of rotating operation plates each have a width corresponding to the width of the card C, and face each other with a predetermined card-holding gap therebetween such that they can be rotated through 180 degrees about shaft pins arranged in the card-holding gap. Thus, the card-inverting mechanism can invert the card C held in the catcher upside down based on processing information (front/back-surface printing information for identifying a to-be-printed surface of the raw card C), as required, to cause the specific surface of the card C to face the transport passage 8.

On the other hand, the card-rotating mechanism is formed by a rotary table capable of receiving and passing a card C. The rotary table has a table surface corresponding to the size of the card C, and is arranged to face the transport passage 8 such that it can be rotated through 180 degrees within a plane of the table by a motor or the like. Thus, the card-rotating mechanism can reverse the card C forward end side backward (make a half horizontal turn) based on processing information (forward/backward printing information for identifying the forward/backward sides of the raw card C), as required, to cause the specific end of the card C to face the transport passage 8. It should be noted that the printer device 11 may be controlled such that it can invert an image forward end side backward based on forward/backward printing information, in place of the card-rotating mechanism. Further, the card-inverting mechanism and the card-rotating mechanism may be constructed by a unitary device.

The card C flicked from the feed roller 31 passes under the processing information readout device 80, and is positioned and set on a suction table 40 by a positioning device, not shown, to be sucked onto the surface of the suction table 40.

The printer-block conveyor device 13 is comprised of the square suction table 40 for sucking and holding the card C, a pair of left and right guide rails 41, 41 extending along the transport passage 8, and a printer-block conveyor belt mechanism 42 for moving the suction table 40 along the guide rails 41, 41. The suction table 40 has the upper surface thereof formed with numerous suction holes, not shown. Further, the suction table 40 incorporates a suction fan 48 communicating with the suction holes. The suction table 40 holds the card C horizontally on the upper surface thereof by sucking the card C by the suction fan 48 and the suction holes. The two guide rails 41, 41, which are supported by the left and right printer-block frames 10, respectively, support the suction table 40 thereon and guide the same for stable movement along the transport passage 8.

The printer-block conveyor belt mechanism 42 is comprised of a pair of table-carrying pulleys 44, 44 arranged at respective locations upstream and downstream (proximal end side and distal end side) of the printer device 11 in a manner opposed to each other, a table-carrying belt 45 stretched between the two table-carrying pulleys 44, 44, and a table-driving motor 46 for driving the proximal end-side table-carrying pulley 44. The table-carrying belt 45 extends between and in parallel with the pair of guide rails 41, 41. The suction table 40 is fixed to a portion of the table-carrying belt 45 via a holding piece 43.

The table-driving motor 46 is connected to the printer-side controller 14. As the table-driving motor 46 rotates, the proximal end-side table-carrying pulley 44 rotates to cause the table-carrying belt 45 to travel in the normal or reverse direction. Thus, the suction table 40 can reciprocate along the transport passage 8 while being supported and guided by the pair of guide rails 41, 41 in a state well-balanced on the left and right.

When the card C is sucked and held horizontally by the suction table 40 as shown in FIG. 4, the card C moved to the printer device 11 by the movement of the suction table 40. When the suction table 40 reaches a predetermined position before the printer device 11, the forward end of the suction table 40 is detected by a table-detecting sensor 47 arranged above the transport passage 8, and the printer-side controller 14 drives the head unit 20 and the reciprocating mechanism 22. As a result, the head unit 20 reciprocates, and the suction table 40 is advanced intermittently, whereby an image is printed on the card C. Then, when the printing on the card C is completed, the suction table 40 travels forward along the transport passage 8 while carrying the card C, to bring the card C to the card transfer device 19.

The card transfer device 19 is comprised of a catcher, not shown, for catching the card C and a transfer mechanism, not shown, for sending the card C onto and from the catcher. The transfer mechanism is connected to the printer-side controller 14. The transfer mechanism is configured such that it can carry out operation for receiving the card C from the printer-block conveyor device 13 and delivering the same to the heater-block conveyor device 17.

It should be noted that, as described in detail hereinafter, the card-making system 1 is configured such that the same has a sensor, not shown, arranged therein which is capable of detecting the front surface or back surface of the card C (i.e. the presence or absence of the information-storing portion 74) at a location forward of the supply roller 31 in the direction of transfer of the card C so as to deliver a result of detection by the sensor to the heater-side controller 18 of the heater block 5.

Next, the components of the heater block 5 will be described in detail. The heater device 16 is formed by an irradiation unit 50 which faces the card C being fed, in a non-contact state. The irradiation unit 50 faces the transport passage 8 therebelow with a predetermined space between the same and the transport passage 8. The irradiation unit 50 is comprised of a halogen lamp 51 which is a light source serving as a heating source, a movable light-blocking plate 52 for blocking part of irradiated light from the halogen lamp 51, and a plate-moving mechanism 53 for moving the light-blocking plate 52 as required. More specifically, the card C is fed while maintaining a constant distance from the halogen lamp 51 arranged thereabove, and when the feed thereof is stopped, the card C is subjected to the heat treatment by the heat emitted from the halogen lamp 51 as required via the light-blocking plate 52. It should be noted that the card C may be heated while being fed.

The halogen lamp 51 is a so-called linear heater which extends in the direction of the width of the apparatus 1 across the card C (i.e. the direction orthogonal to the carrying direction) and has lateral ends thereof supported by the respective heater-block frames 15. The halogen lamp 51 is connected to the heater-side controller 18, which controls the heating temperature of the halogen lamp 51. It should be noted that the halogen lamp 51 may be formed not by a linear heater but by a point-like heater as a point light source. Further, it is preferred that the halogen lamp 51 is formed by a far-infrared lamp, and that a light-diffusing plate is interposed between the halogen lamp 51 and the light-blocking plate 52, for diffusing irradiated light from the halogen lamp 51.

For instance, the light-blocking plate 52 for the stripe magnetic card Ca1 shown in FIGS. 1A to 1C is interposed between the halogen lamp 51 and the transport passage 8 (card C). The light-blocking plate 52 is arranged in parallel with the card C, in the form of an elongated flat plate with a light-blocking portion corresponding to the information-storing portion (magnetic stripe) 74 of the card C (see FIG. 5). The light-blocking plate 52 formed of a heat-resistant material faces the information-storing portion 74 with a predetermined space therefrom such that the light-blocking plate 52 can cover the information-storing portion 74 from above so as to block irradiated light from the halogen lamp 51 to the information-storing portion 74.

Figure 5:
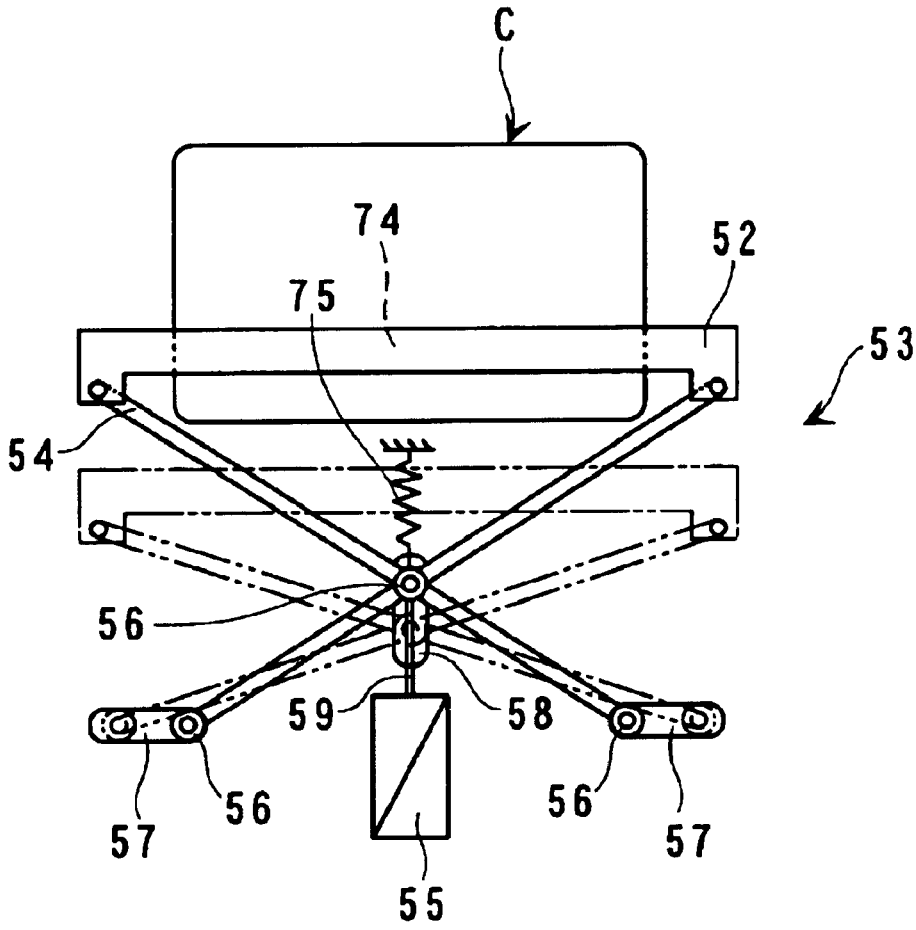
FIG. 5 is a diagram schematically showing the construction of a plate-moving mechanism for moving a light-blocking plate.

As shown in FIG. 5, the plate-moving mechanism 53 includes an X-link 54 pivotally fitted on the opposite ends of the light-blocking plate 52, and a solenoid 55 (actuator) for causing a parallel translation of the light-blocking plate 52 via the X-link 54. The X-link 54 has opposite root ends thereof slidably engaged with parallel guide grooves 57, respectively, parallel to the light-blocking plate 52, by slide barrels 56. Similarly, the X-link 54 has a crossing portion slidably engaged with an orthogonal guide groove 58 extending orthogonal to the light-blocking plate 52 via a slide barrel 56. Further, the slide barrel 56 of the crossing portion of the X-link 54 is connected to a plunger 59 of the solenoid 55. Furthermore, connected to this slide barrel 56 is an extension spring 75 associated with the solenoids 55.

The solenoid 55 is controlled by the heater-side controller 18. When the solenoid 55 is deenergized, the light-blocking plate 52 makes a parallel translation via the X-link 54 by the extension spring 75 to a light-blocking position right above the information-storing portion 74 of the card C, whereas when the solenoid 55 is energized, the light-blocking plate 52 makes a parallel translation from the light-blocking position above the card C via the X-link 54 against the extension spring 75 to a retracted position thereof (indicated by imaginary lines in the figure). Thus, if the printed card C has the information-storing portion 74 on an upper side (in the front surface) thereof, the printed card C is thermally treated via the light-blocking plate 52 moved to the light-blocking position to block direct irradiation to the information-storing portion 74. On the other hand, if the printed card C has the information-storing portion 74 on a lower side (in the back surface) thereof, the light-blocking plate 52 is moved to the retracted position thereof, and the whole surface of the card C is uniformly irradiated by the light for the heat treatment. It should be noted that the plate-moving mechanism 53 may be configured such that the light-blocking plate 52 changes its position between a blocking position and a retracted position thereof by circular motion.

When one of the IC cards Cb shown in FIGS. 2A to 2C is introduced, the light-blocking plate 52 is replaced with a light-blocking plate 52 which is configured to be translucent (transparent) except for the rectangular portion corresponding to the information-storing portion 74 (IC chip). Alternatively, another plate-moving mechanism carrying a light-blocking plate 52 for use with the IC card Cb may be arranged in a manner opposed to the above plate-moving mechanism 53 such that the plate-moving mechanisms are both controlled by the heater-side controller 18 as required. More specifically, the plate-moving mechanism 53 for use with the stripe magnetic card Ca1, and the plate-moving mechanism for use with the IC card Cb are controlled based on processing information (storage portion type information) stored in the information-storing portion 74, for protection of the information-storing portion 74 from heat. However, when the whole-surface magnetic cards Ca2 shown in FIGS. 11A to 11C are introduced, not the light-blocking plate 52 but the amount of heat applied to the whole-surface magnetic card Ca2 is controlled.

The heater-block conveyor device 17 is comprised of a pair of transport guides 60 formed by a plurality of guide rollers 68 and arranged along the respective left and right sides of the transport passage 8 in a manner opposed to each other, and a heater-block conveyor belt mechanism 61 which conveys the card C by pushing the same from the upstream side toward the downstream side while causing the pair of transport guides 60 to guide the card C. The guide rollers 68 on each side are arrayed in a manner such that the whole array extends from a location immediately downstream of the card transfer device 19 to a location immediately upstream of the card exit 7. Each guide roller 68 in the form of an hourglass having an intermediate portion thereof constricted is rotatably supported by a holder, not shown, attached to inner surfaces of the respective heater-block frames 15. The card C is supported by the constricted portions of the guide rollers 68 arrayed in two lines parallel and opposed to each other, in a manner sandwiched from the left and right sides thereof, and stably guided forward with free rotation of the guide rollers 68.

The heater-block conveyor belt mechanism 61 is comprised of a pair of driven pulleys 62 arranged at respective upstream and downstream locations in the transport passage 8, a drive pulley 63 arranged at a location below the transport passage 8, a heater-block drive motor 64 as a driving source for driving the drive pulley 63, and a heater-block conveyor belt 65 stretched for revolving around the pair of driven pulleys 62 and the drive pulley 63. The driven pulleys 62 and the drive pulley 63 are rotatably supported by respective pulley shafts each having opposite ends thereof supported by the respective heater-block frames 15. The heater-block drive motor 64 is connected to the heater-side controller 18, for controlling rotation of the drive pulley 63. The heater-block conveyor belt 65 is formed to have a small width, and has a heater-block conveyor belt 65 has a plurality of pushing pawls 67 (five in FIG. 1) formed on a surface thereof at predetermined space intervals.

Each pushing pawl 67 revolves as the heater-block conveyor belt 65 moves. More specifically, a pushing pawl 67 comes into contact with the trailing end of the card C and revolves while pushing the card C. Accordingly, the card C is carried by being pushed forward by the moving pushing pawl 67 in a state supported by the pair of transport guides 60 on the respective left and right sides and held in a horizontal position, to be brought to the heater device 16, and sent in front of the authentication information-writing device 81, to the card exit 7.

Further, the heater-block conveyor device 17 is provided with a pawl-detecting sensor 69 for detecting a pushing pawl 67. The pawl-detecting sensor 69 is connected to the heater-side controller 18, which determines the position of a pushing pawl 67 such that the pushing pawl 67 can be properly brought into contact with the trailing end of the card C transferred from the card transfer device 19 so as to push the same. More specifically, the heater-side controller 18 performs control such that one pushing pawl 67 immediately preceding the next pushing pawl 67 for pushing the card C is stopped at a predetermined position and functions as a stopper for stopping the card C transferred from the card transfer device 19. As a result, the card C is transferred to the heater-block conveyor belt 65, with its trailing end positioned forward of the proximal end of the heater-block conveyor belt 65, which prevents the pushing pawl 67 for pushing the card C from failing to come into contact with the trailing end of the card C.

The authentication information-writing device 81 is similar in construction to the processing information readout device 80. The authentication information-writing device 81 is formed by a card writer, not shown, which faces the information-storing portion 74 for writing the individual authentication information of the card C in the information-storing portion 74. The card writer connected to the heater-side controller 18 is comprised of a magnetic data-writing device for use with the magnetic card Ca, and an IC data-writing device for use with the IC card Cb. The magnetic data-writing device is formed by a magnetic head for scanning a magnetic stripe and the like while the IC data-writing device is formed by IC connection terminals for connection to the IC chip. The card C passing by the authentication information-writing device 81 has individual authentication information written into the information-storing portion 74 thereof by either of the writing devices, or the processing information stored therein rewritten to individual authentication information. It should be noted that the authentication information-writing device 81 may be constructed separately from the card-making system 1, or data of individual authentication information may be linked to the card-making system 1.

The laminate affixation device 82 also serves as a peeling device, not specifically shown, for peeling off the ink image-receiving sheet IS laminated on the card C. The laminate affixation device 82 is comprised of an affixation mechanism for holding a laminate tape (laminate film) to affix the same to the card C on the transport passage of the heater block 5, and a lift mechanism for lifting and lowering the affixation mechanism. The affixation mechanism and the lift mechanism are connected to the heater-side controller 18. When it is required to apply lamination processing to a surface of the card C, the laminate affixation device 82 peels the ink image-receiving sheet IS off the card C to affix the laminate tape to the exposed surface of the card body 72, based on processing information read from the information-storing portion 74. It should be noted that the laminate affixation device 82 may be arranged at a location backward or upstream of the authentication information-writing device 81 in the carrying direction.

The heater-side controller 18 controls the heater device 16 and the heater-block conveyor device 17 based on results of detection by the printer-side controller 14. More specifically, the heater-side controller 18 determines the heating temperature of the card C in the heater block 5, and controls the movement of the light-blocking plate 52 between the blocking position and the retracted position as well as the card feeding operation, based on attribute information (including the presence or absence of the information-storing portion 74, the laminate structure, the material and thickness of the substrate layer 70, the thickness of the entire card C, etc.) of the card C detected by the printer-side controller 14.

Under the control of the heater-side controller 18, the transferred card C having an image printed thereon is fed forward by the heater-block conveyor device 17, and when the card is advanced to the position of the irradiation unit 50, the feeding operation is stopped for causing the card C to face the irradiation unit 50. Then, the heater device 16 is started or activated and the light-blocking plate 52 is bought to a predetermined position depending on the presence or absence of the information-storing portion 74 of the card C. Then heating operation is carried out at a predetermined heating temperature based on the attribute information of the card. Thus, the card C has the printed image transferred thereto.

After the printed image is transferred to the card C, the controller 9 causes the heater-block conveyor device 17 to start the card feeding operation again for delivering the card C via the card exit 7, thereafter stopping the operations of the heater-block conveyor device 17 and the heater device 16. It should be noted that the amount of heat applied to the card may be controlled by controlling the displacement or shift in position of the light-blocking plate 52 and the heating temperature as well as controlling the speed at which the card is carried by the heater-block conveyor device 17. In short, the card C may be heated while being fed.

As described above, when the card C is discharged from the card exit 7 after being thermally treated, if the user peels off the ink image-receiving sheet IS directly or by using an adhesive tape or the like to expose the ink-fixing layers 71 (or the fluorine film layers 73) to the outside, the user can complete the card C having the printed image thermally transferred into the ink-fixing layers 71 to form a transferred image. However, if the discharged card C has the laminate tape affixed thereto, the user does not have to take the above trouble. It should be noted that when double-sided printing/transferring is to be carried out on a card C, the card C may be discharged via the card exit 7 after one side thereof is printed, and then inverted upside down for being introduced again into the card feeder 12. Alternatively, an inverting mechanism for inverting the card C upside down for double-sided printing may be incorporated in the card transfer device 19.

Next, the control configuration of the card-making system 1 will be described hereinafter. Now, for simplicity, in the following description, it is assumed that the card C is a magnetic card Ca (stripe magnetic card Ca1 or whole-surface magnetic card Ca2). Further, as to a control process for making the IC card Cb, description is made only of a peculiar control process therefor since the overall control process for making the IC card Cb is substantially the same as that for making the magnetic card Ca, but only different in words.

Figure 6:
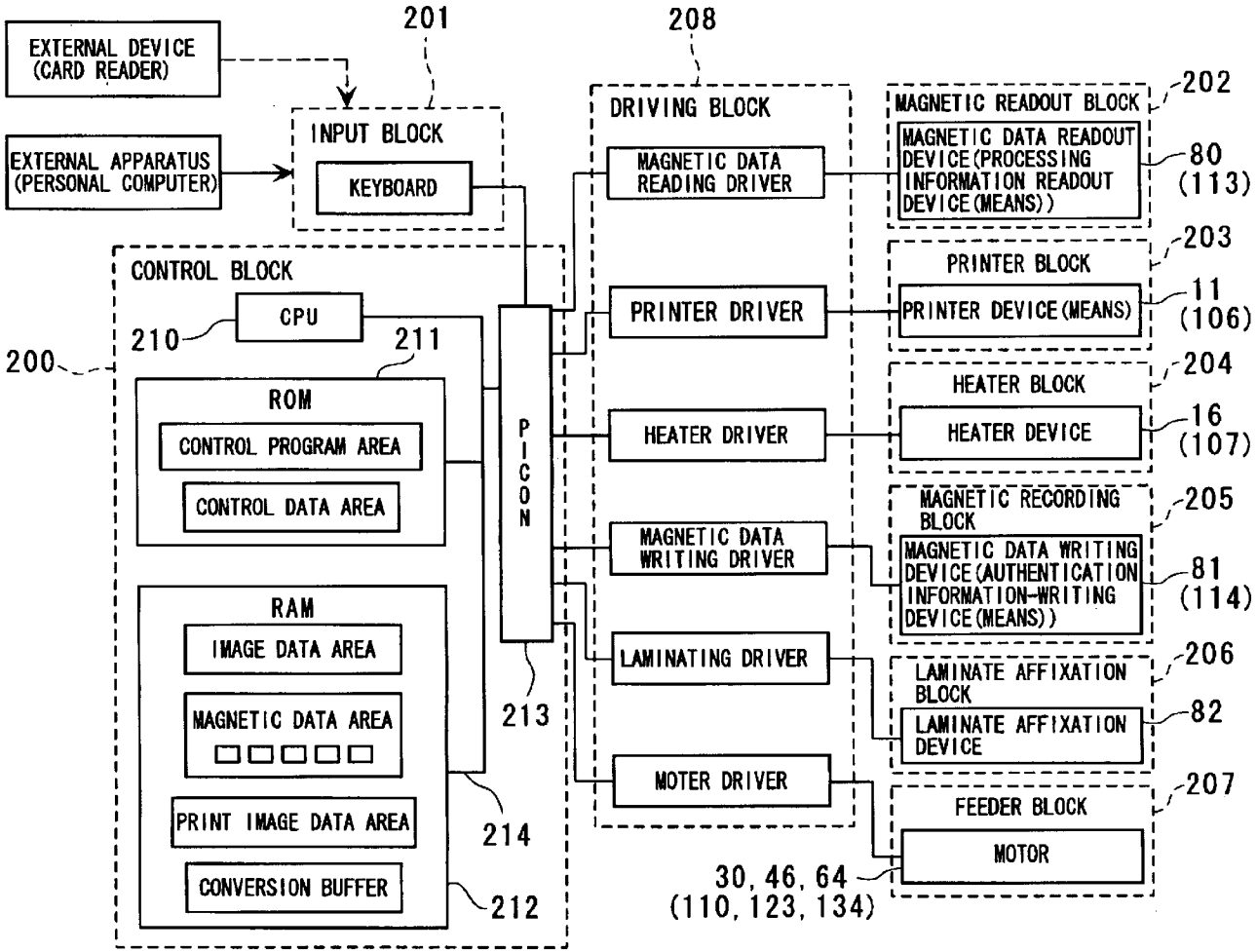
FIG. 6 is a block diagram schematically showing a control system of the card-making system.

FIG. 6 is a block diagram schematically showing a control system of the card-making system 1. As shown in the figure, the card-making system 1 is comprised of an input block 201 which reads in (inputs) image data for forming an image from an external apparatus, such as a personal computer or the like, and inputs magnetic recording data for being recorded as magnetic data by the keyboard operation of a user, a magnetic readout block 202 including a magnetic data readout device (processing information readout device (means)) 80 (113) for reading out magnetic data recorded in advance in the magnetic recording block (magnetic stripe 74, etc) of the card C, a printer block 203 having the printer device (means) 11 (106) for printing an image on the card C, a heater block 204 including the heater device 16 (107) for thermally treating the printed card C, a magnetic recording block 205 including a magnetic data-writing device (authentication information-writing device (means)) 81 (114) for writing magnetic data in the magnetic stripe 74 of the card C, a laminate affixation block 206 having the laminate affixation device 82 for affixing the laminate film on the card C, a feeder block 207 having motors 30, 46, 64 (110, 123, 134) for feeding the card C to the above respective blocks, a driving block 208 including drivers for driving the above blocks 202, 203, 204, 205, 206, 207, and a control block 200 (controller 9) for controlling the above blocks.

The control block 200 includes a CPU 210, a ROM 211, a RAM 212, and a P-CON 213, all of which are connected to each other by a bus 214. The ROM 211 has a control program area for storing control programs executed by the CPU 210 as well as a control data area for storing control data, such as a character table, a color conversion table, and the like, for printing the image on the card C,.

The RAM 212 includes areas of a register group, an image data area for temporarily storing image data input from outside, a magnetic data area for temporarily storing magnetic data read from the magnetic data-writing device, a print image data area for storing image data for use in printing the image, as well as division buffer areas including an image conversion buffer, a color conversion buffer, and so forth. The RAM 212 is used as a work area for carrying out the control process. It should be noted that the magnetic data area is further classified into predetermined areas for storing processing information or individual authentication information ("serial number", "structure code", "material construction code", "card standard code" and "production code") shown in FIG. 7.

The P-CON 213 incorporates a logic circuit for complementing the functions of the CPU 210 as well as dealing with interface signals for interfacing between the CPU 210 and peripheral circuits. The logic circuit is implemented by gate arrays, a custom LSI and the like. To perform its functions, the P-CON 213 is connected to the keyboard, for receiving commands and image data input via the input block 201, and inputting these to the bus 214 directly or after processing them. Further, the P-CON 213 cooperates with the CPU 210 to output data and control signals input to the bus 214 by the CPU 210 or the like, to the driving block 208 directly or after processing them.

According to the control program read from the ROM 211, the CPU 210 of the control block 200 receives signals indicative of results of detection by the respective sensors, and commands and image data input via the P-CON 213, processes various data stored in the RAM 212, and delivers control signals to the driving block 218 via the P-CON 213 to thereby control the printer device 11, the heater device 16, and the like for printing on the card C and heating the same under predetermined printing and heating conditions. Further, the CPU 210 controls the magnetic data-writing device to write magnetic data in the magnetic stripe, or if required, controls the laminate affixation device 82 to affix the laminate film to the card C. In short, the CPU 210 controls the overall operation of the card-making system 1.

For instance, when carrying out image forming control (image printing control), first, the CPU 210 reads magnetic data stored in the card C in advance via the magnetic data-reading device. Normally, five information items shown in FIG. 7 are read at this time, and the printer device 11 and the heater device 16 are controlled based on the "structure code", the "material construction code" and the "card standard code" concerning the image forming process out of codes shown in FIG. 17.

For instance, the "structure code" is indicative of the lamination structure of card C. If the CPU 210 determines based on the structure code that a raw card C inserted has a structure without the fluorine film layer 73, the CPU 210 carries out heating control such that the amount of heat (in terms of a heating temperature and a heating time period) applied to the card C by the heater device does not become too large. For instance, by setting a low heating temperature or a short heating time period in view of a temperature gradient, it is possible to employ a heating mode in which heat conduction in the direction of the thickness of the ink image-receiving sheet IS and the card body 72 is taken into account.

On the other hand, the "material construction code" is indicative of materials of the respective layers (70, 71, 73) forming the card C. If the CPU 210 determines based on the material construction code that a card C inserted is formed by materials requiring high resolution printing, the CPU 210 carries out printing control such that the printer device 11 carries out printing at an increased resolution. More specifically, the resolution of the printer device 11 is increased by increasing the times of ejecting ink from an ink jet head 27, or the number of ejection heads of the printer device 11, thereby increasing the number of dots per unit area. Alternatively, by ejecting a plurality of ink droplets per one dot for carrying out multi-valued recording, the reproducibility of an intermediate tone image is enhanced. Further, the amount of heat applied by the heater device 16 is controlled depending on difference in materials forming the respective layers (70, 71, 73). For instance, the amount of heat is set in advance individually or differently depending on whether the substrate layer 70 is formed of PVC or PET, which contributes to enhancement of transfer quality of an image as well as to prevention of deflection or warpage of the card C.

The "card standard code" is indicative of whether a card C is a stripe magnetic card Ca1 or a whole-surface magnetic card Ca2 of the magnetic cards Ca, or whether it is an IC card Cb or a hybrid card (IC card with a magnetic stripe), or further a location of the magnetic stripe or the IC chip on the card C. The CPU 210 controls the printing process and the heating process based on such information. For instance, when the stripe magnetic card Ca1 has a magnetic stripe exposed to a top surface of the card body 72, similarly to that of a JIS 2 type card, printing operation is carried out such that direct printing on the magnetic stripe is prohibited. Further, so as to prevent the magnetic stripe from being subjected to direct heat irradiation, the light-blocking plate 52, described above, is positioned such that the magnetic stripe is not directly heated, thereby carrying out the heat treatment.

Further, e.g. when the card C inserted is a whole-surface magnetic card Ca2, the position control of the light-blocking plate 52 is not performed, but heating control is carried out such that an optimum amount of heat for transferring an image to the card is emitted by the heater device 19. More specifically, heating temperature is lowered, and at the same time a heating time period is lengthened, whereby thermal influence of heating against the magnetic layer 76 including the information-storing portion 74 is minimized. Further, when a whole-surface magnetic card Ca2 is inserted, as shown in FIGS. 12A and 12B, magnetic data may be input to a plurality of portions, that is, a plurality of tracks of the magnetic layer 76.

Figure 12A:
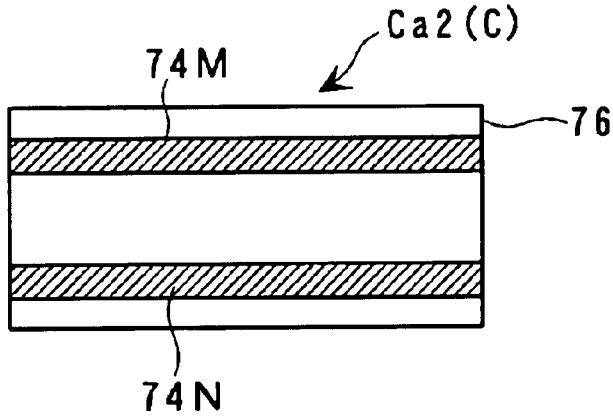
FIGS. 12A and 12B are partial plan views each showing a plurality of information-storing portions of the whole-surface magnetic cards in FIGS. 11A and 11B.
Figure 12B:
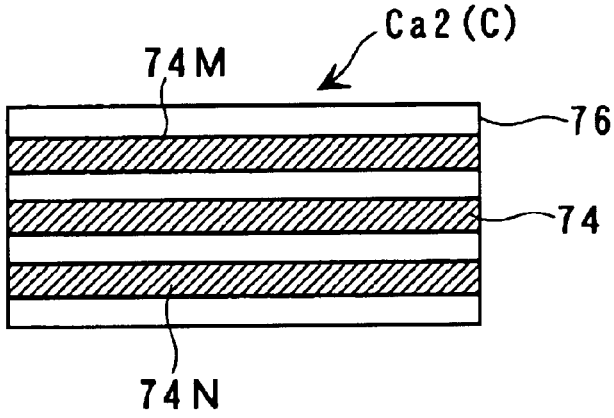

For instance, as shown in FIG. 12A, information-storing portions 74M, 74N are arranged at an upper portion and a lower portion of the magnetic layer 76, respectively. In this case, if the same processing information is recorded such that the magnetic data of the information is recorded in the respective information-storing portions 74M, 74N in the reverse order, there is no need to be sensitive about the forward or backward direction of introduction of a raw card C. Further, as shown in FIG. 12B, processing information of a raw card C may be recorded in an intermediate portion of the magnetic layer 76 and at the same time add information of symbols indicative of the start and end of recorded magnetic data to the processing data such that the forward and backward directions of the raw card C can be specified. Further, individual authentication information exhibiting individual authenticating function for authentication the user or the like is recorded in one (e.g. 74M) of the upper and lower portions of the magnetic layer 76 while recording card-making information for making the authentication card C, referred to hereinafter, in the other portion (e.g. 74N) of the magnetic layer 76 in a manner sandwiching the information-storing portion 74 provided in the intermediate portion.

As described above, printing information and heating information are read from magnetic data recorded beforehand in the card C, and the printer device 11 and the heater device 16 are controlled according to control programs compatible with the printing and heating information, thereby making it possible to form an optimum image for the card C. More specifically, the processing information stored in the information-storing portion 74 makes it possible to employ separately or in combination printing and heating modes which agree with the properties of the ink image-receiving sheet IS and the raw card C, a printing mode which takes the front surface and back surface of the raw card C and the forward end and backward end thereof into account and a heating mode which takes a thermal damage exerted on the information-storing portion 74 into account, or even a heating mode which takes the depth of permeation of a sublimable dye ink into account.

It should be noted that the lamination of a laminate film by the laminate affixation device 82 is determined depending on whether or not a "structure code" read by the magnetic data-reading device is indicative of a structure including the fluorine film layer 73. More specifically, the laminate film is affixed i.e. laminated only to a card C (see FIGS. 1A and 2A) having no fluorine film layer 73 provided in advance. Alternatively, when it is determined that there is no need to carry out the lamination processing, no laminate film is affixed for the sake of cost reduction.

Now, the magnetic data-reading device reads not only data ("structure code", "material construction code", and "card standard code") recorded for controlling the image forming process, as described above, but also the "serial number", and the "production code" which provide information utilized for the security of the card, mainly for preventing forgery thereof.

For instance, the "serial number" is a management number (source identification information) assigned to the raw card C, recorded at the stage of production of the raw card C. When a duplicate number or a number out of management is read by the card-making system 1, the CPU 210 stops printing the print image. More specifically, all the serial numbers read by the magnetic data-reading device are stored in a predetermined area, such as a magnetic data area or the like, and when the same number as a number stored in the past, or a number out of management (number without a record of production) is detected, printing of a print image is stopped, thereby making it possible to prevent a forged raw card C from being flowed out and used illegally. In this case, the card-making system 1 is preferably configured such that the apparatus not only stops printing an image on a target card C but also warns the user of the fact, or causes the card C to be discharged from the card exit 7 without carrying out any image forming processing on the card C.

The "production codes" are largely classified into codes indicative of production information (source identification information) of raw cards C and codes indicative of card-making information of authentication cards C. Production information of a raw card C is indicative of the production place and date of the raw card C, and by reading the production information, it is possible to use it for eliminating an old raw card C quality of which can be deteriorated due to aging, or an off-quality card which is regarded as one erroneously produced. Particularly, when an ink image-receiving sheet IS is affixed to a raw card C at a time point of producing the card C, the production information can serve quality control, e.g. for preventing deterioration of the ink image-receiving sheet IS. In this case as well, the card-making system 1 may be configured such that it can issue a warning or the like.

Further, card-making information of an authentication card C is indicative of the date and place of making the authentication card C. This information is written in an information-storing portion of the card C as part of individual authentication information by the magnetic data-writing device. This makes it possible to use the card-making information for the quality control of an authentication card C and prevention of forgery thereof after the card C leaves the card-making system 1 and is distributed for actual use in the world.

More specifically, if the card-making information of an authentication card C, and the processing information thereof including printing conditions, heating conditions, and the like at the time point of making the card C are stored in the form of the "production code" as history information of the authentication card C in the card-making system 1, the production code of a card C suspected of being forged can be checked against the production code stored in the cord-making system 1, while further investigating the printed image (especially, state of permeation of ink) of the suspected card C, whereby it is possible to determine whether or not the suspected card C is one printed and heated by the proper method.

The above-mentioned history information may be stored in the card-making system 1 or in the internal storage device or external storage medium of a personal computer. In the case of the latter, history information is linked between the card-making system 1 and the personal computer. This makes it possible to suitably store history information and read it out easily as required.

It should be noted that the information-storing portion 74 may be configured to have a processing information-storing portion for storing processing information, and a authentication information-storing portion for storing individual authentication information, which are incorporated in the card independently of each other. For instance, even a stripe magnetic card Ca1 may be provided with two tracks of magnetic stripes for storing processing information and individual authentication information, respectively.

According to the card-making system 1 to which is applied the present invention (card-making method and system), the processing information and source identification information of a raw card C are stored in the information-storing portion of the raw card C in advance, and the processing information and source identification information are read out to carry out image forming processing. This makes it possible to form an image adapted to an individual card C suitably and without fault by making use of the processing information and source identification information read from the information-storing portion 74, and markedly increase the security properties of a raw card C and an authentication card C.

Further, according to the above-mentioned card-making system 1 to which is applied the present invention (heat treatment mechanism for cards and image-forming apparatus incorporating the same), it is possible, through a sequence of operations carried out within the casing 2, not only to print an image on a card C by the printer device 11 but also to transfer a print image to the card by directly blocking irradiation of light to the information-storing portion 74 during heat treatment by the heater device 16. As a result, it is possible to apply heat treatment to the entire card C in a state in which the thermal influence of heating against the information-storing portion 74 is properly prevented through prevention of irradiation of light to the information-storing portion 74 and the accompanying heat concentration thereto.

Figure 8:
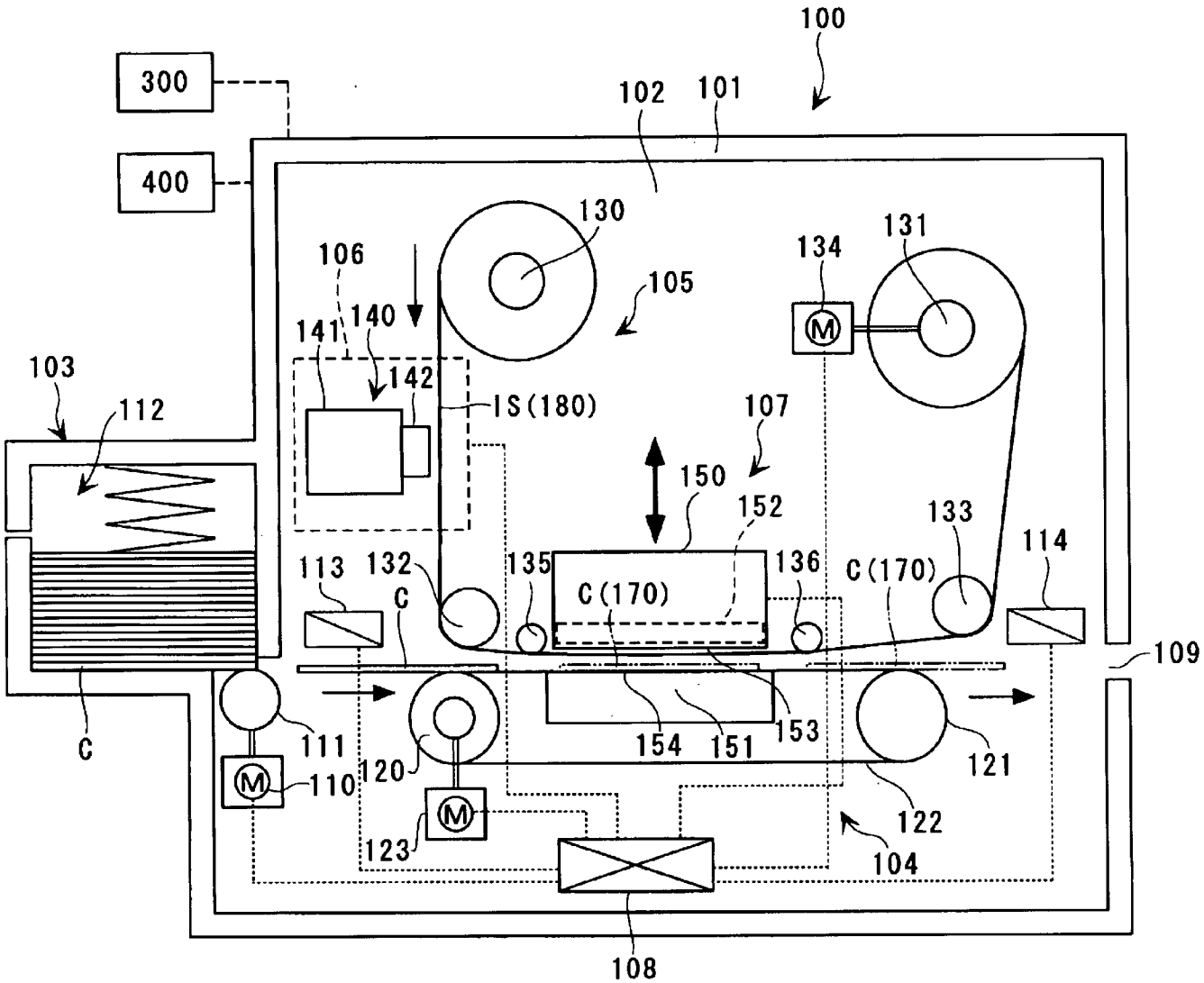
FIG. 8 is a cross-sectional view showing the internal construction of a card-making system according to a second embodiment of the invention.

FIG. 8 is a plan view showing the internal construction of the card-making system 100 according to a second embodiment of the invention. FIGS. 9A to 9D are cross-sectional views schematically showing a procedure of forming an image on a card according to the second embodiment. The card-making system according to the present embodiment uses an ink image-receiving sheet IS as a so-called transfer sheet, and hence although the second embodiment is slightly different from the first embodiment in the card-making procedure and processing operations, the gist of the process for making an authentication card C is the same as that of the first embodiment. Particularly, the control process for making an authentication card C in the first embodiment can be applied to the present embodiment.

As shown in FIG. 8, the card-making system 100 has an apparatus body 102 including an outer shell formed by a box-shaped casing 101, card feeding-means 103 for feeding a card C, card conveyor means 104 for carrying the card C, a card exit 109 via which the card C is delivered out of the casing 101, processing information readout means 113 arranged at a location forward or downstream of the card feeding-means 103 for reading out processing information of the card C, authentication information-writing means 114 for writing individual authentication information in the card C at a position backward or upstream of before the card exit 109, sheet-feeding means 105 for rolling out and feeding a roll of an ink image-receiving sheet IS, printing means 106 for printing on the ink image-receiving sheet IS rolled out by the sheet-feeding means 105, thermal pressing means 107 (heater device) for pressing the printed ink image-receiving sheet IS to the card C while applying heat thereto, laminate affixation means, not shown, for affixing a laminate tape to the card C, and a controller 108 for controlling these means.

The card-making system 100 prints an image including characters, figures, and so forth on the ink image-receiving sheet IS by the ink jet printing method using a sublimable dye ink while feeding the ink image-receiving sheet IS, overlays the portion of the ink image-receiving sheet IS printed with the image onto a card C, and heats the overlaid sheet portion and card while applying pressure thereto, thereby causing the image to be fixed to the card C and develop color.

Now, the card C and the ink image-receiving sheet IS will be described in detail prior to description of each means of the card-making system 100. The card C according to the present embodiment is configured such that the ink image-receiving sheets IS are removed from the card C employed in the first embodiment. More specifically, the card C is formed by only the card body 72 of a raw card C. The card body 72 has an information-storing portion 74 arranged therein.

Further, the ink image-receiving sheet IS used in the present embodiment is different from the ink image-receiving sheet IS used in the first embodiment in that the it is not formed of the resin material which has an adhesive property and is easy to peel off by heating, but formed of a resin material whose image-receiving surface to be printed with an image is smooth and flexible and has a continuous shape. In this embodiment, it is preferred that the ink image-receiving sheet IS is formed of an aqueous resin material having PVA (polyvinyl alcohol) as a main component. This makes it possible to enhance absorbency of a sublimable dye ink such that ink droplets are temporarily impregnated into the ink image-receiving sheet IS and held in the same.

Figure 9A:
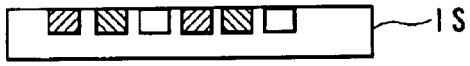
Figure 9B:
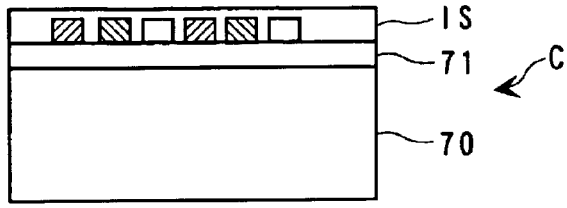
Figure 9C:
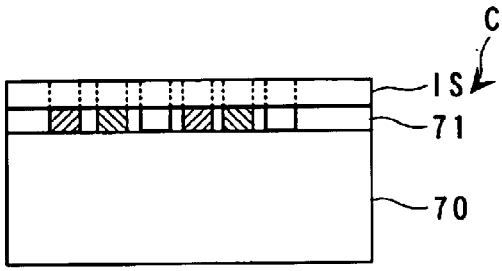
Figure 9D:
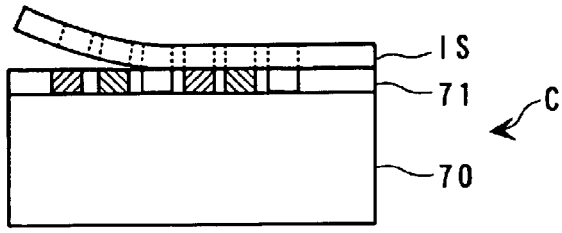

As shown in FIGS. 9A to 9D, when an image is printed on the ink image-receiving sheet IS by the printing means 106 by the ink jet printing method, ink droplets of the sublimable dye ink are impregnated into the ink image-receiving sheet IS and held in the same (FIG. 9A). Then, when the printed surface of the ink image-receiving sheet IS and the surface of a card C are overlaid one upon the other (FIG. 9B) and thermally pressed in this state, the ink droplets further penetrate deep into an ink-fixing layer 71 as migration particles having sizes at a molecular level (FIG. 9C). More specifically, heating causes evaporation/diffusion of the ink droplets held in the ink image-receiving sheet IS, in the ink-fixing layer 71, and color development. Consequently, when the ink image-receiving sheet IS is removed from the card C (FIG. 9D), the card C having the image transferred to the ink-fixing layer 71 is produced.

Next, the components of the card-making system 100 will be described in detail. The card delivery means 103 is generally similar in construction to the card feeder 12 in the first embodiment and comprised of a delivery motor 110 as a drive source, a delivery roller 111 rotated by the delivery motor 110, and a card cassette 112 containing a plurality of cards C in a stacked state. The delivery roller 111 is constantly held in rolling contact with the underside surface (substrate layer 70) of a lowermost card C of the stack so as to reliably feed the cards C one by one from the card cassette 112 and transfer the same properly to the card conveyor means 104. For the details, the first embodiment should be referred to.

Similarly, the printing means 106 is generally similar in construction to the printer device 11 in the first embodiment. Ink droplets are ejected from the ink jet head 142 as required, whereby printing is effected on the ink image-receiving sheet IS. More specifically, in the present embodiment, while the ink image-receiving sheet IS passing in front of the head unit 140 is intermittently fed along a sheet traveling passage 180, the head unit 140 performs reciprocating motion in a direction orthogonal to the direction of feeding the ink image-receiving sheet IS, whereby printing is performed on the ink image-receiving sheet IS. In the present embodiment, it is preferred that a mirror or reverse image of a desired image is printed on the ink image-receiving sheet IS so as to form a normal image of the desired image by transfer of the mirror image of the same onto a card C.

The card conveyor means 104 is arranged along a card transport passage 170 for communication between the card delivery means 103 and the card exit 109. The card conveyor means 104 is comprised of a pair of pulleys 120, 121 arranged in parallel with the card transport passage 170 at respective locations upstream of and downstream of the thermal pressing means 107, a conveyor belt 122 stretched between the pair of pulleys 120, 121, and a belt motor 123 for driving the conveyor belt 122 by rotation of one of the pulleys. The pulley 120 on the upstream side is arranged in the vicinity of a supply roller 111 in a manner opposed to a first guide roller 132 via the card transport passage 170. The pulley 121 on the downstream side is arranged in the vicinity of the card exit 109 in a manner opposed to a second guide roller 133 via the card transport passage 170. The belt motor 123 as a drive source is connected to the controller 108 for controlling travel of the conveyor belt 122.

The conveyor belt 122 formed by a heat resistant silicone has a width corresponding to the width of the card C. Further, the conveyor belt 122 forms the horizontal card transport passage 170 arranged at a location immediately under a thermal pressing device 150 for the thermal pressing means 107. The conveyor belt 122 is stretched for revolving around a press-receiving base 151, and at the same time slidably travels on the top surface of the press-receiving base 151. The card C is passed from the supply roller 111 via the processing information readout means 113 to the conveyor belt 122, carried through the thermal pressing means 107 along the card transport passage 170, and further transported from the conveyor belt 122 via the authentication information-writing means 114 to the card exit 109, followed by being delivered out therefrom.

The processing information readout means 113 is similar in construction to the processing information readout device 80 in the first embodiment. The processing information readout means 113 is formed by a card reader, not shown, which faces the card transport passage 170 (more particularly, the information-storing portion 74 of the card C), for reading out processing information of the card C. The card reader connected to the controller 108 is comprised of a magnetic data-reading device adapted to the information-storing portion 74 of a magnetic card Ca, and an IC data-reading device adapted to the information-storing portion 74 of an IC card Cb. The card C passing under the processing information readout means 113 has its processing information including information of the type thereof (the magnetic card Ca or the IC card Cb) read out, and the image forming process is carried out on the card C, for printing and thermally pressing the card C based on the processing information.

The authentication information-writing means 114 is similar in construction to the processing information readout device 113. The authentication information-writing means 114 is formed by a card writer, not shown, which is arranged to face the information-storing portion 74 for writing the individual authentication information of the card C in the information-storing portion 74. The card writer connected to the controller 108 is comprised of a magnetic data-writing device for the magnetic card Ca, and an IC data-writing device for the IC card Cb. The card C passing by the authentication information-writing means 114 has the individual authentication information written in the information-storing portion 74 thereof, or alternatively its processing information stored therein rewritten to the individual authentication information.

The sheet-feeding means 105 is comprised of a supply reel 130 arranged at a left-hand location as viewed in the figure, for rolling out the ink image-receiving sheet IS, a take-up reel 131 arranged at a right-hand location as viewed in the figure, for taking up the ink image-receiving sheet IS, the first guide roller 132 for guiding the ink image-receiving sheet IS rolled out by the supply reel 130 to the printing means 106, the second guide roller 133 for guiding the ink image-receiving sheet IS from the first guide roller 132 to the thermal pressing means 107, and a take-up motor 134 for driving the take-up reel 131, and a pair of passage projections 135, 136 arranged at respective locations upstream of and downstream of the thermal pressing means 107. The supply reel 130, the first guide roller 132, and the second guide roller 133 are freely rotatable members, and the first guide roller 132, the thermal pressing means 107, the second guide roller 133, and the pair of passage projections 135, 136 define the sheet traveling passage 180 from the supply reel 130 to the take-up reel 131.

The supply reel 130 is arranged at a location upstream of the printing means 106. Around the supply reel 130 is wound the un-used ink image-receiving sheet IS in the form of a roll. The ink image-receiving sheet IS is wound around the supply reel 130 such that the image-receiving surface rolled out can face the head unit 140. The supply reel 130 and the first guide roller 132 are disposed at the respective locations on opposite sides of the printing means 106 and define part of the sheet traveling passage 180 parallel to the head unit 140, along which the ink image-receiving sheet IS is fed.

The pair of passage projections 135, 136 are formed by a first passage projection 135 arranged between the first guide roller 132 and the thermal pressing means 107, and a second passage projection 136 arranged between the thermal pressing means 107 and the second guide roller 133. The pair of passage projections 135, 136 are arranged in parallel with the sheet traveling passage 180 so as to position the ink image-receiving sheet IS in parallel with the card transport passage 170. That is, the image-receiving surface of the ink image-receiving sheet IS having been printed with an image and sent from the first guide roller 132 such that travelling thereof is guided by the first passage projection 135 has its image-receiving surface positioned to face the card C on the conveyor belt 201 in parallel therewith between the pair of passage projections 135, 136.

The take-up reel 131 is driven for rotation by the take-up motor 134 to take up the ink image-receiving sheet IS after being thermally pressed. More specifically, the ink image-receiving sheet IS is rolled out from the supply reel 130 by rotation of the take-up reel 131 and taken up by the take-up reel 131. The second guide roller 133 is arranged between the take-up reel 131 and the second passage projection 136.

More specifically, the second guide roller 133 guides the ink image-receiving sheet IS which is being taken up by the take-up reel 131 after pressing the thermal pressing means 107 and the second passage projection 136, such that the ink image-receiving sheet IS is fed in an inclined or oblique direction with respect to the card transport passage 170. In short, the second guide roller 133 not only guides the feed of the ink image-receiving sheet IS but also serves as separating means for separating the ink image-receiving sheet IS, which has been overlaid to the card C by the thermal pressing means 107, from the card C.

The thermal pressing means 107 includes the thermal pressing device 150, and the press-receiving base 151 arranged in a manner parallel and opposed to the thermal pressing device 150 via the card transport passage 170 and the sheet traveling passage 180. The thermal pressing device 150 contains a heater 152 serving as a heating source, and has a pressing surface 153 parallel to the card transport passage 170, and slightly larger in size than the surface of the card C. The thermal pressing device 150 is connected to the controller 108, and can be moved in upward and downward directions by a lift mechanism, not shown, connected to the controller 108. In short, the thermal pressing device 150 has the heating temperature of the heater 152 (pressing surface 153) adjusted by the controller 108 while being moved downward by the lift mechanism for pressing the pressing surface 153 against the press-receiving base 151 in a manner sandwiching the ink image-receiving sheet IS and the card C therebetween.

The press-receiving base 151 has a press-receiving surface 154 corresponding and parallel to the pressing surface 153, and is surrounded by the conveyor belt 122 traveling around the same. More specifically, the press-receiving surface 154 of the press-receiving base 151 is located close to the surface of part of the conveyor belt 122 traveling above the base 151, and the press-receiving base 151 cooperates with the thermal pressing device 150 so as to affix the ink image-receiving sheet IS to the card C by pressing these to each other while applying heat to them. Further, it is preferred that the pair of passage projections 135, 136 as well are configured to be capable of moving vertically together with the thermal pressing device 150.

The laminate affixation means is different from the laminate affixation device 82 in the first embodiment in that it does not serve as a peeling device for peeling off the ink image-receiving sheet IS since in the second embodiment, the ink image-receiving sheet IS automatically separates from the card C. More specifically, the laminate affixation means is comprised of an affixation mechanism for holding a laminate tape to affix the same to the card C on the card transport passage, and a lift mechanism for lifting and lowering the affixation mechanism. The affixation mechanism and the lift mechanism are connected to the controller 108. When it is required to apply lamination processing to the surface of the card C, the laminate affixation means affixes the laminate tape to the surface of the card C, based on processing information (structure code) of the information-storing portion 74.

The controller 108 includes the CPU 210 and the like for performing various kinds of control processes similar to the control processes carried out by the controller in the first embodiment (see FIG. 6). Within the casing 101, there are arranged two sensors, not shown, connected to the controller 108 and facing the sheet traveling passage 180 at respective locations on opposite sides of the printing means 106, and a sensor, not shown, facing the card transport passage 170 at a location close to the supply roller 111. The position of a to-be-printed or printed portion of the ink image-receiving sheet IS is detected by these sensors, and based on the sensed position of the printed portion, the printed portion of the ink image-receiving sheet IS and the card C fed by the supply roller 111 are properly aligned with each other and passed through the thermal pressing means 107. It should be noted that in place of arranging the sensors, even transport information for transporting the sheet IS and the card C may be stored in the information-storing portion 74 of the card C such that the image forming process can be carried out based on the information.

The detailed flow of operations for forming an image on the card C is as follows. The card C delivered from the card delivery means 103 is fed to the thermal pressing means 107 via the processing information readout means 113 by the card conveyor means 104, while the ink image-receiving sheet IS printed with the image by the printing means 106 is fed to the thermal pressing means 107 by the sheet-feeding means 105. At this time, feed of the card C and the ink image-receiving sheet IS is temporarily stopped, and the image printed on the ink image-receiving sheet IS and the card C are completely positioned or aligned with each other between the pair of pulleys 120, 121. Then, the card C is firmly pressed by the thermal pressing device 150 from the ink image-receiving sheet side while receiving heat.

Thus, the card C is brought into surface contact with the pressing surface 153 such that the entire area of the surface of the card C can be uniformly heated and pressed, and the image printed on the ink image-receiving sheet IS is transferred to the surface (ink-fixing layer 71 or fluorine film layer 73) of the card body 72. Then, the ink image-receiving sheet IS is taken up while being separated from the card C, whereas the card C having the image fixedly formed thereon is sent via the authentication information-writing means 114, followed by being delivered from the card exit 109. The card C is also subjected to lamination processing, if required, and distributed to a user as an authentication card C.

As described hereinabove, similarly to the first embodiment, in the present embodiment as well, processing information of a raw card C is stored in advance in the information-storing portion 74 of the raw card C, and the process for forming an image on the raw card C is carried out based on the processing information. Further individual authentication information of an authentication card is written in the information-storing portion 74, whereby it is possible to properly make the authentication card from the raw card.

Figure 10:
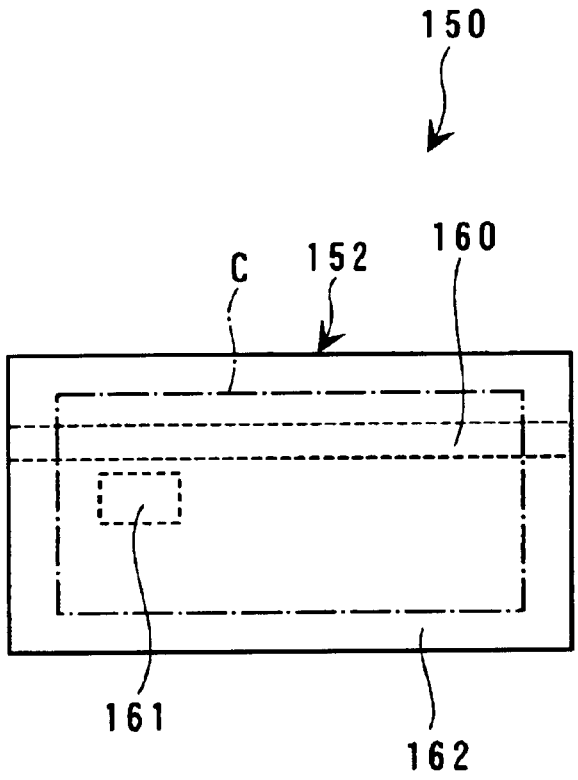
FIG. 10 is a plan view showing a divisional heat block of a thermal pressing device for the card-making system according to the second embodiment.

In the present embodiment, differently from the first embodiment, contact heating is carried out on a card C. Therefore, the heating process may be controlled in the following manner: Referring to FIG. 10, the thermal pressing device 150 for carrying out the heating process contains a heater 152 comprised of a plurality of divisional heating sections which are capable of partially heating the card C depending on the type thereof. More specifically, the divisional heating sections are formed by a first heating section 160 arranged at a location corresponding to the magnetic stripe of a magnetic card Ca, a second heating section 161 arranged at a location corresponding to the IC chip of an IC card Cb, and a main heating section 162 arranged at an area other than the locations at which the first heating section 160 and the second heating section 161 are arranged. The heating blocks 160, 161, 162 are each connected to the controller 108 for having the heating state thereof controlled as required, based on processing information (storage portion type information).

For instance, when the IC card Cb is subjected to heat treatment, whose IC chip is exposed on the top surface of a card body 72 thereof, the heat treatment is carried out by driving the main heating section 162 and the first heating section 160 without driving only the second heating section 161 alone (by turning off the power for the same) such that the IC chip is prevented from being heated in direct contact with the heating sections. Although the heating sections 160, 161, 162 are arranged as shown in the figure, this is not limitative, but if the IC chip is arranged at another location (e.g. at a central left portion of the card Cb, as viewed in FIG. 10), the divisional heating sections may be arranged in a manner corresponding to this position of the IC chip. It should be noted that the heating sections 160, 161, 162 may be formed by respective separate heaters (heater arrays).

It goes without saying that in this case as well, the heating temperature and heating time period of each of the heating sections 160, 161, 162 are controlled based on processing information, and since the contact heating method is employed in the present embodiment, the pressure contact force of the thermal pressing device 150 is also controlled by the controller 108.

It should be noted that in the present embodiment, a sheet cartridge which is formed by accommodating the supply reel 130, the take-up reel 131, and the ink image-receiving sheet IS in a single cartridge casing may be removably arranged in the casing 101. In this case, the sheet cartridge may be configured such that the sheet traveling passage 180 for the ink image-receiving sheet IS is defined in the cartridge casing, and openings are formed at locations corresponding to the thermal pressing device 150 and the head unit 140. This makes it possible to facilitate handling of these components during transport thereof, including storage of the ink image-receiving sheet IS. Further, a faint original image remaining on the ink image-receiving sheet IS can be completely destroyed or caused to disappear by dissolving the ink image-receiving sheet IS by water after the image on the ink image-receiving sheet IS is transferred, which contributed to prevention of forgery of a card C.

Figure 13:
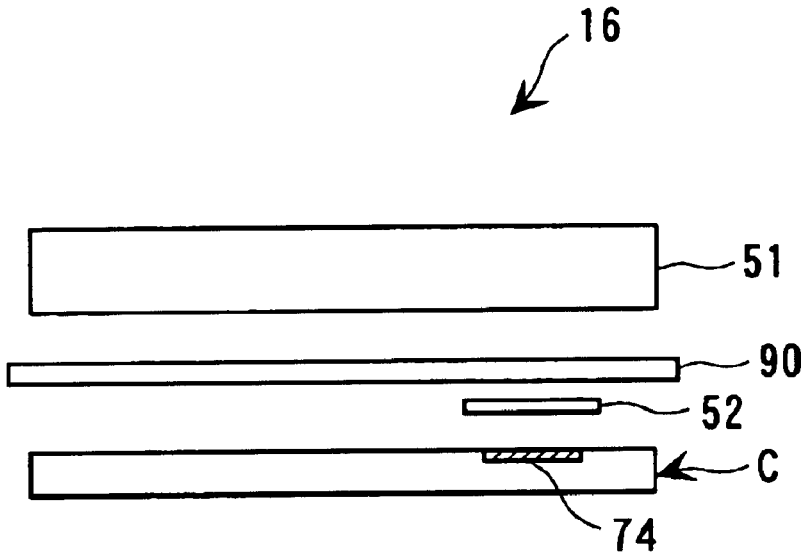
FIG. 13 is a front view schematically showing a variation of a heater device.

Next, a plurality of variations of the heater device 16 according to the present invention will be described. FIG. 13 shows a first variation of the heater device 16, which corresponds to an enlarged front view of the heater device 16 appearing in FIG. 4 (FIG. 5), viewed from the direction of feed of a card C. In this variation, a light-diffusing plate 90 is fixedly interposed between the light-blocking plate 52 and halogen lamp 51 of the irradiation unit 50 to diffuse irradiated light from the halogen lamp 51 for thermally treating the card C. The light-diffusing plate 90 having a predetermined heating area is formed of heat-resistant glass in the form of a flat plate parallel and opposed to the card C. The light-diffusing plate 90 is slightly larger in size than the card C such that it can cover the surface of the card C including four edge portions thereof. Thus, the light emitted from the halogen lamp 51 as a linear light source can be diffused, thereby enabling the light-diffusing plate 90 to serve as a planar light source for heating the card C.

This makes it possible to uniformly irradiate light to the front end and rear end areas of the card C in the direction of feed thereof similarly to a central portion directly under the halogen lamp 51. Therefore, the card C is subjected to uniform heat irradiation within a plane thereof, and hence the amount of heat received by the ink image-receiving sheet IS which forms the uppermost surface of the card C is leveled in the planar direction. Consequently, the card C is subjected to the uniform planar emission to have the transferred image free of color irregularity formed thereon. It should be noted that heat-resistant glass is preferably formed by a material having high light transmittance, thermal diffusivity, and heat conductivity. In short, it is preferable to use Neoceram as heat-resistant glass.

Further, in the above case, the light-diffusing plate 90 may be one which serves as an optical filter. More specifically, the light-diffusing plate 90 may be configured such that the same transmits only a specific wavelength range of light while absorbing or reflecting the other wavelength ranges of light. This makes it possible to block a wide wavelength range of irradiated light to allow the card C to be heated by only the specific or predetermined wavelength range of light, thereby preventing variation in the amount of the energy of light (amount of heat) received by the surface of the card C. In other words, it is possible to prevent variation in the depth of diffusion of the sublimable dye ink due to different energies of light caused by different irradiated light caused by different wavelengths thereof and thereby uniformly heat the card C in the direction of the thickness (direction of the lamination) thereof.

More specifically, the light-diffusing plate 90 is configured such that it allows only far-infrared rays having long wavelengths to pass therethrough, whereby it is possible to transmit far-infrared rays as the light irradiated onto the card C while blocking e.g. visible light which has short wavelengths carrying energy large enough to burn the ink image-receiving sheet IS. This makes it possible to uniformly heat the card C up to an inner layer (substrate layer 70) thereof and at the same time enhance heat efficiency in comparison with visible light or the like.

However, an optical filter formed as a separate member from the light-diffusing plate 90 may be incorporated in the irradiation unit 50. In this case, the optical filter may be arranged on a halogen lamp side of the light-diffusing plate 90, or on a card side thereof. Further, if the halogen lamp 51 is configured such that it is capable of uniformly irradiating light in the planar direction, only an optical filter formed of heat-resistant glass or the like may be arranged in place of the light-diffusing plate 90.

It is preferred that as the halogen lamp 51, there is selected a halogen lamp which uses a far-infrared radiation wavelength range as a main wavelength range. This makes it possible not only to carry out heat irradiation on the card C by far-infrared rays, thereby uniformly transferring the irradiated heat to the inside of the card C in the direction of the thickness thereof but also to further enhance heat efficiency in cooperation with the above function of the optical filter.

Figure 14A:
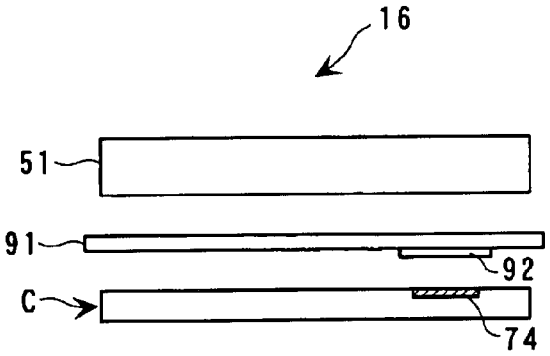
FIGS. 14A and 14B are front views schematically showing other variations of the heater device.

FIG. 14A schematically shows a second variation of the heater device 16. In this variation, a light-transmissive separation board 91 is employed in place of the light-blocking plate 52. The separation board 91 has part of the surface thereof subjected to mask processing in a manner associated with the information-storing portion 74, and this masked part or area is used for blocking irradiated light directly emitted to the information-storing portion 74. The separation board 91 has a predetermined heating area, and is formed of a heat-resistant material in the form of a flat plate, the whole of which has uniform transmittance. The separation board 91 is formed to be slightly larger than the card C such that it can cover the entire surface of the card C including four edge portions thereof when it becomes parallel and opposed to the card C.

Figure 14B:
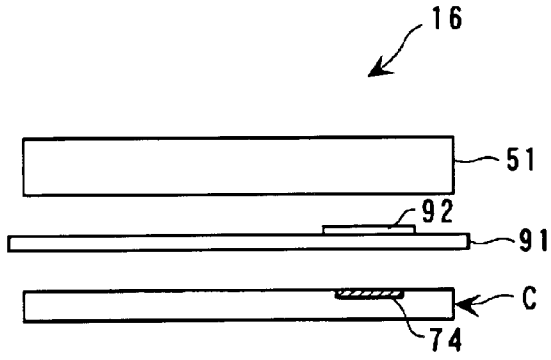

Further, the separation board 91 has part of the surface thereof formed with a mask portion 92 subjected to the above mask processing. The mask portion 92 is a metal thin film deposited on the card side of the separation board 91 by a physical vapor deposition method, such as ion plating or the like, and formed in a manner corresponding to the area of the information-storing portion 74 of the card C (see FIG. 14A). The mask portion 92 reflects or absorbs irradiated light, at a location between the halogen lamp 51 and the card C so as to prohibit the irradiated light from transmitting therethough. It should be noted that as shown in FIG. 14B, the mask portion 92 may be formed on the halogen lamp side of the separation board 91. In this case, the separation board 91 may be moved unlimitedly close to the surface of the card C.

Thus, the card C has the card body except for the information-storing portion 74 thermally treated by heat of irradiated light in a state in which a portion of the irradiated light emitted to the information-storing portion 74 is blocked by the mask portion 92. It should be noted that the separation board 91 may be formed as the same light-diffusing plate 90 as employed in the second embodiment to cause the separation board 91 to serve as a planar light emitter for the card C. Similarly, the separation board 91 may be caused to serve as an optical filter for the card C. In this case, it is preferred that the separation board 91 is formed to be slightly larger, and at the same time the same moving mechanism 53 as used in the first embodiment is provided to cause the separation board 91 to be parallely moved to retract the mask portion 92 to a retracted position thereof. In such a case, even if the card C has no information-storing portion 74 in a surface thereof, it is possible to emit light by the separation board 91 as the planar light emitter.

Although in the second embodiment, ink image-receiving sheets IS coated with adhesives are used for the card C, this is not limitative, but a card C having the ink image-receiving sheet IS simply placed upon each ink-fixing layer 71 may be used.

It is further understood by those skilled in the art that the foregoing are preferred embodiments of the invention, and that various changes and modifications may be made without departing from the spirit and scope thereof.

What is claimed is:

1. A card-making method of making an authentication card from a raw card having a readable and writable information-storing portion formed therein, by forming an image on at least one of a front surface and a back surface of the raw card and writing individual authentication information in the information-storing portion, the card-making method comprising the steps of:

writing processing information of the raw card in the information-storing portion;

forming the image based on the processing information read from the information-storing portion; and writing individual authentication information of the authentication card in the information-storing portion after forming the image.

2. A card-making method according to claim 1, wherein the step of forming the image comprises the steps of:

printing the image on an ink image-receiving sheet by using a sublimable dye ink, overlaying the ink image-receiving sheet to a surface of the raw card after the printing step, and thermally transferring the sublimable dye ink from the ink image-receiving sheet onto the surface of the raw card by heating the ink image-receiving sheet after the overlaying step.

3. A card-making method according to claim 1, wherein the step of writing and individual authentication information includes rewriting the processing information to the individual authentication information.

4. A card-making method according to claim 1, wherein the individual authentication information comprises card-making information including a date of making of the authentication card.

5. A card-making method according to claim 1, further including the step of storing the processing information as history information of the authentication card prior to the writing step.

6. A card-making method according to claim 1, further including the step of writing source identification information of the raw card in the information-storing portion prior to the step of forming the image.

7. A card-making method according to claim 6, wherein the source identification information comprises production information including a date of production of the raw card.

8. A card-making method according to claim 1, wherein the information-storing portion includes a processing information-storing portion for storing the processing information, and an authentication information-storing portion for storing the individual authentication information, which have been formed in the raw card, independently of each other.

9. A card-making method of making an authentication card from a raw card having a readable and writable information-storing portion formed therein, by forming an image on at least one of a front surface and a back surface of the raw card and writing individual authentication information in the information-storing portion, the card-making method comprising the step of writing source identification information of the raw card in the information-storing portion.

10. A card-making method according to claim 9, wherein the source identification information comprises production information including a date of production of the raw card.

11. A card-making system for making an authentication card from a raw card having a readable and writable information-storing portion formed therein, by forming an image on at least one of a front surface and a back surface of the raw card and writing individual authentication information in the information-storing portion, the card-making system comprising:

processing information-writing means for writing processing information of the raw card in the information-storing portion;

processing information readout means for reading out the processing information from the information-storing portion;

image forming means for forming the image on the raw card;

image-forming control means for controlling said processing information readout means and said image forming means; and authentication information-writing means for writing individual authentication information of the authentication card in the information-storing portion, wherein said image-forming control means controls an image forming process carried out by said image forming means for forming the image, based on the processing information read from the information-storing portion.

12. A card-making system according to claim 11, wherein said image forming means includes:

a printer mechanism for printing the image on an ink image-receiving sheet by using a sublimable dye ink, an overlaying mechanism for overlaying the ink image-receiving sheet to a surface of the raw card after printing, and a thermal transfer mechanism for thermally transferring the sublimable dye ink from the ink image-receiving sheet onto the surface of the raw card by heating the ink image-receiving sheet after completion of overlaying.

13. A card-making system according to claim 11, further including history information storage means for storing the processing information as history information of the authentication card.

14. A card-making system according to claim 13, wherein said history information storage means is formed by a personal computer linked to said processing information-writing means.

15. A card-making system according to claim 11, further including identification information-writing means for writing source identification information of the raw card in the information-storing portion.

16. A card-making system according to claim 11, wherein the information-storing portion includes a processing information-storing portion for storing the processing information, and an authentication information-storing portion for storing the individual authentication information, which have been formed in the raw card independently of each other.

17. A card-making system according to claim 11, wherein at least said processing information readout means, said image forming means, and said image-forming control means out of said processing information-writing means, said processing information readout means, said image forming means, said image-forming control means, and said authentication information-writing means are accommodated in a single casing to form a card-making apparatus.

18. A heat treatment mechanism for applying heat treatment to a card having an information-storing portion arranged in part of a surface of a card body of a card, by using a light source as a heating source, to thereby fix an image to the card, wherein the heat treatment mechanism comprises a light-blocking plate which is arranged such that the light-blocking plate is positioned between the card and the light source to block irradiated light to the information-storing portion.

19. A heat treatment mechanism according to claim 18, including a light-diffusing plate interposed between the light source and said light-blocking plate, for diffusing the irradiated light from the light source.

20. A heat treatment mechanism according to claim 19, wherein said light-diffusing plate also serves as an optical filter for allowing only light in an infrared radiation wavelength range, out of the irradiated light from the light source, to transmit therethrough, and said light-diffusing plate is formed of heat-resistant glass in the form of a flat plate arranged in parallel with the card.

21. A heat treatment mechanism according to claim 18, wherein the light source is formed by a halogen lamp which emits far-infrared rays as radiation in a main wavelength range.

22. A heat treatment mechanism for applying heat treatment to a card having an information-storing portion arranged in part of a surface of a card body of a card, by using a light source as a heating source, to thereby fix an image to the card, wherein the heat treatment mechanism comprises a light-transmissive separation board arranged between the light source and the card, and wherein said separation board has a mask portion provided in a manner associated with the information-storing portion, for blocking irradiated light to the information-storing portion.

23. A heat treatment mechanism according to claim 22, wherein said mask portion is a thin film formed by carrying out surface treatment by a dry process.

24. A heat treatment mechanism according to claim 23, wherein the thin film is formed by depositing a metal material on said separation board by a physical vapor deposition method.

25. A heat treatment mechanism according to claim 22, wherein said separation board is formed by a light-diffusing plate for diffusing the irradiated light from the light source.

26. An image-forming apparatus for forming an image on a card having an information-storing portion arranged in part of a surface of a card body of the card, the image-forming apparatus comprising:

a printer mechanism for printing the image on an ink image-receiving sheet by using an sublimable dye ink; and a heat treatment mechanism for applying heat treatment to the card body and the ink image-receiving sheet printed with the image which are overlaid to each other, by using a light source as a heating source, to thereby fix the image printed on the image-receiving sheet to the card, the heat treatment mechanism including a light-blocking plate which is arranged such that the light-blocking plate is positioned between the card and the light source to block irradiated light to the information-storing portion.

* * * * *